US008622236B2

(12) United States Patent
Sanbrook et al.

(10) Patent No.: US 8,622,236 B2
(45) Date of Patent: Jan. 7, 2014

(54) DRINKING VESSEL USABLE IN DIFFERENT ORIENTATIONS

(75) Inventors: Peter Sanbrook, Chirnside Park (AU); Sean Edwin Moran, Montmorency (AU); Jon Seddon, Surrey Hills (AU)

(73) Assignee: Sanbrook Innovations Pty Ltd, Boronia, Victoria (AU)

( * ) Notice: Subject to any disclaimer, the term of this patent is extended or adjusted under 35 U.S.C. 154(b) by 837 days.

(21) Appl. No.: 12/532,390

(22) PCT Filed: Mar. 19, 2008

(86) PCT No.: PCT/AU2008/000401
§ 371 (c)(1),
(2), (4) Date: Sep. 21, 2009

(87) PCT Pub. No.: WO2008/113129
PCT Pub. Date: Sep. 25, 2008

(65) Prior Publication Data

US 2010/0127005 A1 May 27, 2010

(30) Foreign Application Priority Data

Mar. 21, 2007 (AU) ..... 2007901484

(51) Int. Cl.
*A47G 19/22* (2006.01)
*B65D 83/00* (2006.01)

(52) U.S. Cl.
USPC ..... 220/705; 220/708; 220/714; 220/717; 215/388

(58) Field of Classification Search
USPC ..... 220/705, 708, 711, 714, 717, 252, 709; 215/387–389; 239/33
See application file for complete search history.

(56) References Cited

U.S. PATENT DOCUMENTS

| | | | | |
|---|---|---|---|---|
| 2,687,628 | A | 8/1954 | Cunningham | |
| 4,016,998 | A | 4/1977 | Finch | |
| 5,938,053 | A | 8/1999 | Verbovszky et al. | |
| 6,196,413 | B1 | 3/2001 | Tung | |
| 6,290,090 | B1 * | 9/2001 | Essebaggers | 220/710 |
| 6,293,441 | B1 | 9/2001 | Tasaki et al. | |
| 6,915,961 | B2 * | 7/2005 | Renz et al. | 239/33 |
| 7,651,003 | B2 * | 1/2010 | Albers et al. | 215/311 |
| 7,748,643 | B2 * | 7/2010 | Renz et al. | 239/33 |
| 7,819,276 | B2 * | 10/2010 | Naesje | 220/714 |
| 2004/0129714 | A1 | 7/2004 | Thompson | |

(Continued)

FOREIGN PATENT DOCUMENTS

| | | | |
|---|---|---|---|
| AU | 603127 | B2 | 8/1987 |
| CN | 87106409 | A | 3/1988 |
| DE | 203 02 721 | U1 | 6/2003 |
| DE | 20 2004 019090 | | 12/2004 |

(Continued)

*Primary Examiner* — Steven A. Reynolds
*Assistant Examiner* — Javier A Pagan
(74) *Attorney, Agent, or Firm* — Merchant & Gould P.C.

(57) ABSTRACT

A drinking vessel is provided for use in an upright orientation and an upturned orientation. The vessel includes a mouthpiece portion and a conduit portion fluidly connected to the mouthpiece portion. The conduit portion has a lower opening through which fluid may be drawn to the mouthpiece portion when the vessel is oriented in a substantially upright orientation. The vessel further includes an intermediate inlet (fluidly connected to the mouthpiece portion. The intermediate inlet is disposed intermediate the lower opening and the mouthpiece portion. The vessel further includes a flow controller operable to control flow to the mouthpiece portion from the intermediate inlet, according to the orientation of the vessel. A lid for a drinking vessel and a drinking conduit are also claimed.

24 Claims, 18 Drawing Sheets

(56) References Cited

U.S. PATENT DOCUMENTS

| | | | | |
|---|---|---|---|---|
| 2005/0133519 | A1 | 6/2005 | McDonough | |
| 2006/0226110 | A1 | 10/2006 | Choi et al. | |
| 2008/0302793 | A1 * | 12/2008 | Tirosh et al. | 220/203.17 |

FOREIGN PATENT DOCUMENTS

| | | | |
|---|---|---|---|
| JP | 2000-139662 | A | 5/2000 |
| WO | WO 02/26583 | A1 | 4/2002 |
| WO | WO 2007/069257 | A2 | 6/2007 |

* cited by examiner

DRINKING VESSEL USABLE IN DIFFERENT ORIENTATIONS

This application is a National Stage Application of PCT/AU2008/000401, filed 19 Mar. 2008, which claims benefit of Serial No. 2007901484, filed 21 in March 2007 and which applications are incorporated herein by reference. To the extent appropriate, a claim of priority is made to each of the above disclosed applications.

FIELD OF THE INVENTION

The present invention relates to drinking vessels. In particular, although not exclusively, the invention relates to training/starter cups for use by infants which have graduated from a baby bottle and are not yet able to effectively drink out of an open cup without risk of spilling the contents. The invention may also have applications to travel situations where the risk of spillage is high. The invention may also lend itself to use by the elderly, disabled or infirm. The invention also relates to drinking containers for fully able members of the population.

BACKGROUND OF THE INVENTION

Assisted-drinking cups, which do not require the user to lift an open cup to his mouth can generally take two different forms. One particular type, referred to as a training cup, includes a liquid container with a lid that has a spout. The spout has a liquid outlet which can be opened by a mechanical manipulation or by suction from the user. Such cups are generally referred to as training cups because they assist in a child's development of being able to lift the cup and coordinate movement to position the spout in the infant's mouth.

In an alternative type of cup, a straw extends into the vessel through the lid. This enables the contents of the vessel to be consumed without having to tip the vessel.

These two different types of vessels have their particular uses depending upon the position and abilities of the user.

It is an object of the present invention to provide a drinking vessel which has increased functionality or at least provides the public with a useful choice over known drinking vessels. Alternative objects of the invention include the provision of a lid for a drinking vessel and/or the provision of a drinking conduit which provides increased functionality or at least provides the public with a useful choice over known products.

The foregoing prior art discussion is not to be taken as an admission of common general knowledge.

SUMMARY OF THE INVENTION

In accordance with a first aspect of the present invention there is provided a lid portion for a drinking vessel, the lid portion including:

- a mouthpiece portion;
- a conduit portion fluidly connected to the mouthpiece portion, the conduit portion having a distal opening through which fluid may be drawn to the mouthpiece portion;
- an intermediate inlet fluidly connected to the mouthpiece portion, the intermediate inlet disposed intermediate the distal opening and the mouthpiece portion; and
- a flow controller operable to control flow to the mouthpiece portion from the intermediate inlet, according to the orientation of the vessel.

In accordance with a second aspect of the invention, a drinking vessel is provided which includes the lid portion above. Thus, the lid portion and the drinking vessel of the invention may include any of the optional features discussed below.

Preferably, the vessel can be used in a number of different orientations while still allowing fluid to be drawn through the mouthpiece portion. With the vessel seated on its base, fluid within the vessel will be disposed towards the base such that fluid may be drawn from the distal opening by suction applied to the mouthpiece portion. A squeeze action may also force liquid through the conduit portion. Suitably, the conduit portion and the distal opening are such that fluid can be drawn to effectively empty the vessel. The vessel may also be inclined whereupon the flow controller operates to enable fluid flow from the intermediate inlet instead of the distal opening.

The intermediate inlet may be disposed in the conduit portion, preferably closer to the mouthpiece than the distal opening. Alternatively, the intermediate inlet may be formed in a mouthpiece member which also incorporates the mouthpiece portion. In yet another form of the invention, a subsidiary conduit portion may be provided which is fluidly connected to the mouthpiece portion and the intermediate inlet may be disposed in the subsidiary conduit portion.

The conduit portion is typically in the form of a tube or straw. The distal opening may be disposed at the bottom of the straw. Preferably, the straw extends to the base of the vessel. The bottom of the straw may have a spoon-shaped end to effectively act as a "slurpee" straw for drinks containing small ice particles. Further, the straw may be arcuate, especially towards the base to optimise its function at low drink levels. The conduit portion may comprise two or more tubular parts which are separable to facilitate manufacture or cleaning. The conduit portion may also include a flavouring portion. In one known form of flavoured straws sold under the trade name SIPAHH, flavoured beads are held within by plastic filters at each end.

Various configurations are possible for the vessel, the mouthpiece portion and the conduit portion. Various parts may be formed or moulded together. For example, the vessel may be a unitary vessel which includes integrally moulded side walls, lid portion and mouthpiece. However, in a more preferred form of the invention, the vessel comprises a container portion with an upper opening and the lid portion closes the upper opening. Suitably, the mouthpiece portion is incorporated into the lid portion and is integral therewith. Alternatively, the mouthpiece portion may be formed separately from the lid portion and inserted there into. The mouthpiece portion and the lid portion may be separable for cleaning. The lid portion and the container may be completely separate. Alternatively, the lid may be joined by means of a hinged connection such as an integral flexible hinge.

The conduit portion need not be in the form of a discrete tube. The conduit portion may be integrally formed into the side wall of the vessel or the container portion.

The conduit portion may be integrally formed with the mouthpiece portion. For example, the mouthpiece portion and the conduit portion may be simply a straw with the mouthpiece portion being merely defined at the upper end of the straw as the portion able to be inserted into the user's mouth.

In this form of the invention, there is preferably an annular seal provided to seal between the outside of the straw and the surrounding portion of the vessel to prevent spillage therebetween when the vessel is inverted.

The vessel may be in the form of a container with a lid portion and the straw may project through the lid portion.

Such drinking vessels described above may also include folding straw systems whereby the straws can be closed off by folding. Such folding straw systems may include a silicone or resilient mouthpiece portion which is closed off by folding or rotating.

The normally exposed end of the straw may be provided with a closure to prevent inadvertent spilling of the contents of the vessel. The closure may be in the form of a simple cap covering the end or a portion thereof. Alternatively, the end may incorporate a self-closing valve. The valve may be in the form of a slit valve which is integral with the end. Such an exposed end might be referred to as a "bite-activated mouthpiece". Alternatively, the whole upper end of the vessel may be provided with an overcap. The overcap may be separate from the remainder of the vessel. Alternatively, the overcap may be hingedly connected. An integral plastic hinge may be provided to interconnect the vessel and the overcap. The conduit portion, mouthpiece portion and lid portion could be integrally formed or at least of unitary form (one piece). Alternatively, the conduit portion may matingly engage with an underside of the mouthpiece portion and be separable therefrom. The mouthpiece portion may incorporate a recess to receive an upper end of the conduit portion. Alternatively, the mouthpiece portion may incorporate a dependent tubular portion which defines a recess into which the upper end of the conduit portion may be fitted.

The mouthpiece portion suitably includes a liquid outlet and is preferably of the self-closing type to prevent inadvertent spillage. The mouthpiece portion may be in the form of a spout which is deformable under mechanical action. Such mechanical action might include biting on the exterior of the spout or applying lip pressure so as to squeeze together the side walls of the spout (bite-activated mouthpiece). Such mechanical action preferably results in opening of a liquid outlet in the spout. In a preferred form of the invention, the spout is such that the liquid outlet is not able to be opened by suction alone and requires mechanical deformation in order to open the liquid outlet.

Whether the conduit portion is integral with the mouthpiece portion or fitted into it, preferably the location of the top end of the conduit portion is such that deformation of the mouthpiece portion is still permitted. For example, there may be a gap between the upper end of the conduit portion and the top of the mouthpiece portion.

In an alternative form of the invention, the mouthpiece portion or spout, instead of being deformable may be a substantially rigid plastic mouthpiece portion. The rigid plastic mouthpiece portion may incorporate a liquid outlet and may also include a liquid outlet valve to prevent inadvertent spillage from the mouthpiece when the vessel is knocked over.

In the soft form of the mouthpiece portion or spout, the liquid outlet may comprise one or more openings formed in a membrane. The membrane may be formed of different material to the remainder of the spout and thus may have different properties. The membrane may be overmoulded into the spout. Preferably, the membrane is the same material as the remainder of the spout but is thinner than the remainder of the spout. In a preferred form, the membrane is a flat planar structure at the top of the spout. The one or more openings may be in the form of a plurality of slits. Preferably the slits have a long dimension aligned with the usual direction of force applied during deformation.

The flow controller operates according to the orientation of the vessel. Preferably, the flow controller closes the intermediate inlet when the vessel is seated on its base, thus enabling fluid to be drawn from the lower opening of the conduit portion when the user applies suction to the mouthpiece portion. Conversely, when the vessel is sufficiently tilted or in an upturned orientation, the flow controller operates to open the intermediate inlet so that liquid may flow from the intermediate inlet to the mouthpiece portion. Preferably, the flow controller is in the form of a valve member which is disposed at the intermediate inlet.

Preferably, the position of the valve member is dependent on the orientation of the vessel. Accordingly, the valve member may be movable under the action of gravity. Additionally or alternatively, the valve member may be responsive to a change in orientation of the vessel. More specifically, the valve member may be moved under the action of fluid flow in the vessel. For example, the action of fluid flowing towards the mouthpiece portion when the vessel is tilted may serve to open the valve member. Thus the arrangement of the valve member being at least partly or wholly exterior of the valve arrangement and/or the intermediate inlet enables the valve closure portion to be acted on by fluid in the vessel.

The valve member may be cooperable with the intermediate inlet to close off the inlet in the upright orientation. Preferably, the valve member is heavier than fluid within the container (a specific gravity significantly greater than 1). Accordingly, the valve member will sink to move away from the intermediate inlet when in the inverted position. The heavy valve member will also assist with seating on the valve seat. The disposition of the intermediate inlet and the valve member may thus be arranged accordingly. Alternatively, the valve member may be lighter than the liquid within the vessel, i.e. the valve member may operate as a float. In this case, preferably the float moves away from the inlet when in the inverted position. The arrangement of the float and the intermediate inlet may be designed accordingly.

An upper stop may be provided for the valve member to abut in the open position. This may be provided on the conduit portion.

The intermediate opening may take the form of a curved or substantially annular opening surrounding the main portion of the conduit portion. There may be a plurality of intermediate openings arranged in an arc or ring. An appropriate form for the valve member would thus be curved or ring-shaped. In an alternative configuration, the intermediate inlet may be formed at the end of a branch portion from the main portion, in which case, the valve member may take the form of a flap which seats on the intermediate inlet. The valve member may be separable from the conduit portion. The valve member may be separately formed from the conduit portion and assembled together. In one form of the invention, the valve member may be incorporated into a valve component which includes a ring which locates around the main portion and doubly serves to provide a seal within an opening of the lid in which the ring is fitted. The valve component may be integrally formed from elastomeric material constructed to utilise the spring memory characteristics to aid in returning to the seated (sealed) position.

The valve member, particularly in the above described form of a flap, may instead be integrally moulded with one or other of the components of the vessel which include the mouthpiece portion, the conduit portion, the lid portion or the container wall.

An air inlet or "breather valve" may be provided to allow air to enter the vessel as liquid is removed. Preferably the air inlet is self-closing to prevent inadvertent spillage. The air inlet may be incorporated into the lid portion. Preferably, the air inlet is integrally moulded as part of the mouthpiece portion or spout. The air inlet may comprise a valve having one or more openings formed in a membrane. The membrane may merely be thinner than the surrounding material of the mouthpiece portion or spout. The air inlet may be disposed at the base of the side wall of the spout.

In a preferred construction, the mouthpiece portion/spout, the air inlet and liquid outlet are all integrally moulded into a dispensing portion of resilient material. Deformation of the spout may cause opening of both the air inlet and the liquid outlet. The dispensing portion is overmoulded into a surrounding portion of harder material which together may form the lid portion. The harder surrounding portion is suitably provided with engagement means to secure to the container portion, e.g. mutually cooperable threads or a snap fit.

Preferably, the mouthpiece portion or spout is disposed on an upper portion of the vessel in a forward position and the container portion has a base and a container wall which leans in a forwards direction when the container is seated on its base on a level surface.

The spout may be in the form of a tubular protrusion from the upper portion. The tubular protrusion may be angled such that its upper end extends forwardly.

The drinking vessel may be provided with handle portions which lie at an angle substantially aligned with the leaning angle of the container portion. The combination of the angled spout, container and handles assists the infant in co-ordinating the action of gripping the handles and tipping the vessel to orientate the vessel into the infant's own mouth.

A base portion may be provided to seat the leaning container portion. The base portion may be separable from the leaning container portion. Alternatively, the base portion and the container portion may be integrally formed. In a most preferred form of the invention, the container portion and the base portion are made of different materials with the container portion being transparent so that the contents are visible.

In accordance with a third aspect of the invention, there is provided a drinking vessel for use in an upright orientation and an upturned orientation, the vessel including:

- a mouthpiece portion;
- a conduit portion fluidly connected to the mouthpiece portion, the conduit portion having a lower opening through which fluid may be drawn to the mouthpiece portion when the vessel is oriented in a substantially upright orientation;
- an intermediate inlet fluidly connected to the mouthpiece portion, the intermediate inlet disposed intermediate the lower opening and the mouthpiece portion;
- a flow controller operable to control flow to the mouthpiece portion from the intermediate inlet, according to the orientation of the vessel.

In accordance with a fourth aspect of the present invention there is provided a drinking conduit having two ends including a first end for uptake of fluids and a second end to serve as a mouthpiece, the drinking conduit also provided with an intermediate inlet disposed intermediate the first end and the second end, and a flow controller operable to control flow to the second end from the intermediate inlet, according to the orientation of the conduit.

The drinking conduit may have any of the features described in connection with the conduit portion of the first and second aspects described above.

The drinking conduit may be employed in a unitary vessel without a lid. For example, the vessel may be in the form of a package such as a pre-packaged beverage. In such a product, the straw may be provided externally of the package and the package may have a frangible opening for insertion of the straw.

In the case of pre-packaged beverages, the straw may instead reside within the vessel prior to opening, the straw being extensible on opening to provide an exposed end outside the vessel.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

BRIEF DESCRIPTION OF THE DRAWINGS

In order that the invention may be more fully understood, some embodiments will now be described by way of example with reference to the figures in which.

DETAILED DESCRIPTION OF THE EMBODIMENT

Figure 1:
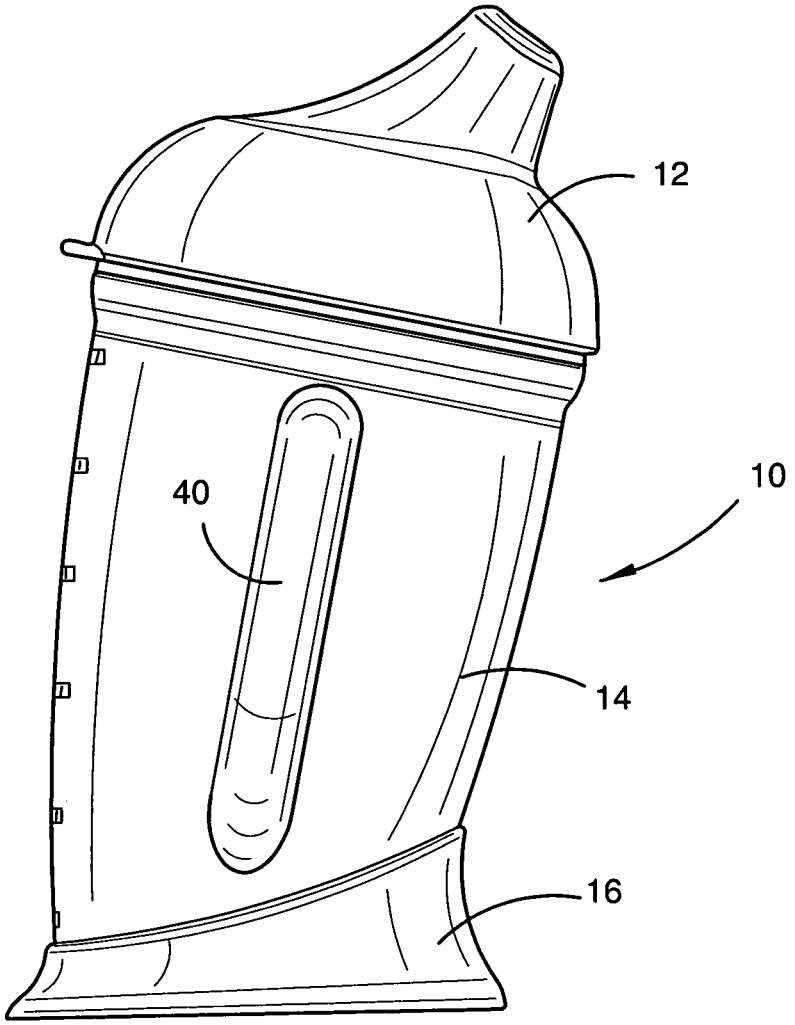
FIG. 1 is a side view of a training cup according to a preferred embodiment of the present invention.

As shown in FIG. 1, the training cup 10 includes a cover portion 12 and a container portion 14 which is supported by base portion 16. The cover portion 12 extends over the top of a lid portion 18 as can be most clearly seen in FIG. 3.

The lid portion includes a dispensing portion 17 surrounded by a peripheral flange portion 24.

The dispensing portion 17 of the lid portion 18 is constructed of a relatively flexible material such as rubber or a thermoplastic elastomer. The dispensing portion 17 incorporates a mouthpiece or spout 20 and surrounds an air inlet 22 provided on an upper surface of the lid portion, behind the spout 20, substantially at the base thereof.

The peripheral flange portion 24 is constructed of a less flexible material than the dispensing portion 17 to enable the lid 18 to be securely attached to the container portion 14. The peripheral flange portion 24 is thus provided with internal screw threads 26 which are complementary to external screw threads 28 provided on the container portion 14. The dispensing portion 17 and the peripheral flange portion 24 may be united in an overmoulding process so as to form a unitary lid 18. From FIG. 3, it can be seen that an outer periphery 19 of the dispensing portion 17 overlaps an inner periphery 23 of the peripheral flange portion 24. The air inlet 22 is disposed adjacent these overlapping portions 19, 23, inside the inner periphery 23.

In an overmoulding process, the two parts may be moulded together by injecting two different types of plastics material from separate barrels, i.e. twin barrels. Alternatively, in a process which is also referred to as insert moulding, a part may be inserted into a mould and another part moulded around it. Thus, the flexible dispensing portion 17 may be preformed and then inserted into a mould, enabling the surrounding flange portion 24 to be moulded around the dispensing portion 17. Alternatively, the surrounding flange portion 24 may be moulded first and the flexible dispensing portion 17 moulded into the surrounding flange portion 24.

It can be seen that the cover portion 12 has a shape which is generally complementary to the external shape of the lid 18. The cover 13 may be secured to the lid 18 by purely a frictional fit. A rearward projecting tab 30 is provided on the cover portion 12 to assist removal.

Figure 3:
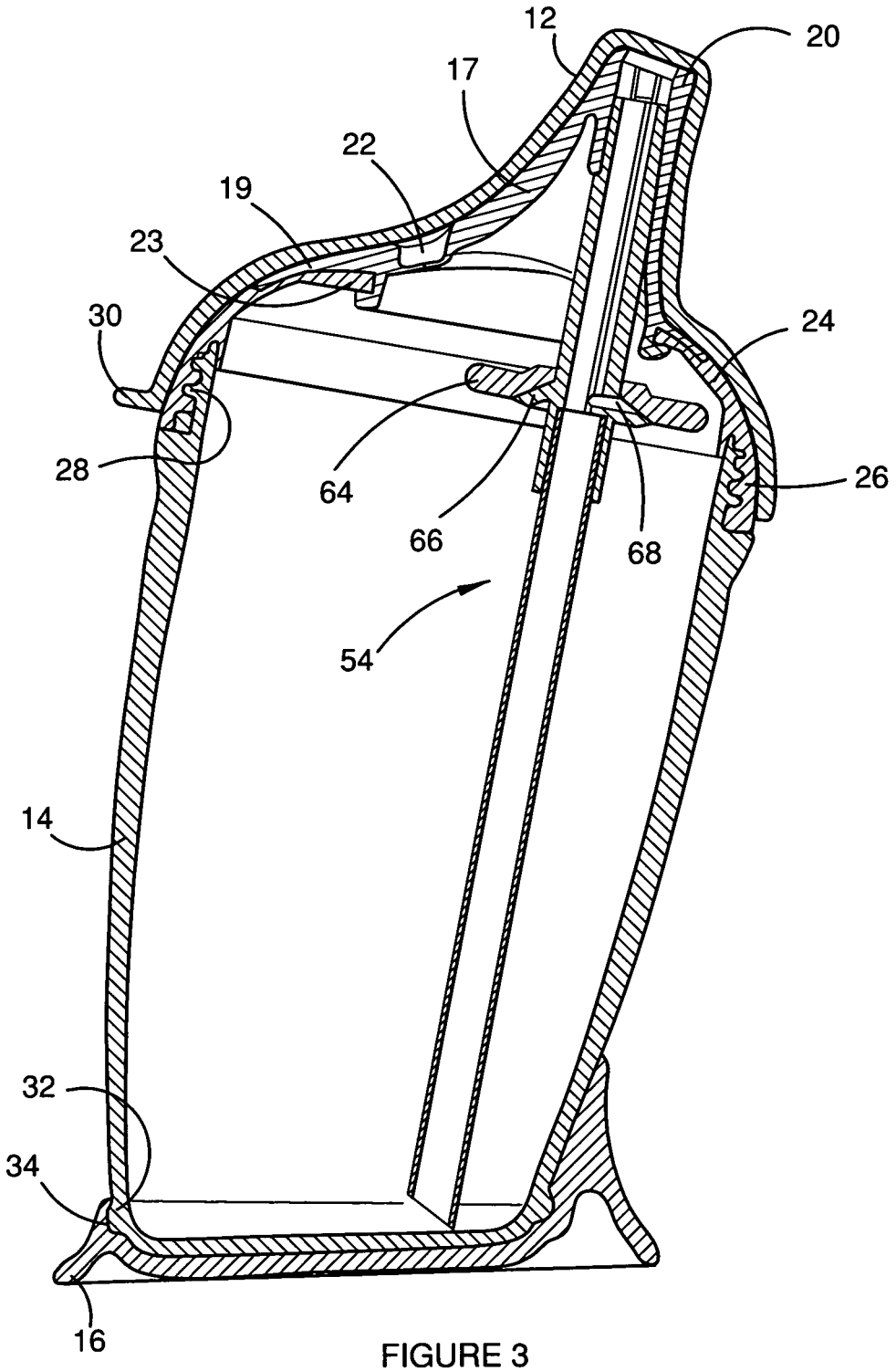
FIG. 3 is a cross-sectional view of the training cup through A-A of FIG. 2.

The container portion 14 is received in a base portion 16 as shown in FIG. 3. The external periphery of a lower portion of the container portion 14 is complementary to the internal periphery of the base portion 16. In particular, the container portion may have an externally projecting annular rib 32 which mates with an annular groove 34 provided in the base portion 16. The container portion 14 and the base portion 16 may be united in the moulding process. Alternatively, they may be separable to allow separate cleaning. The base portion 16 may be moulded of a plastics material which is more flexible than the container portion 14 to provide grip onto the surface onto which the cup 10 is placed. The base portion 16 may be constructed of the same material as the dispensing portion 17 of the lid 18. The base portion 16 and the container portion 14 may be united by an overmoulding process or adhered together.

Figure 2:
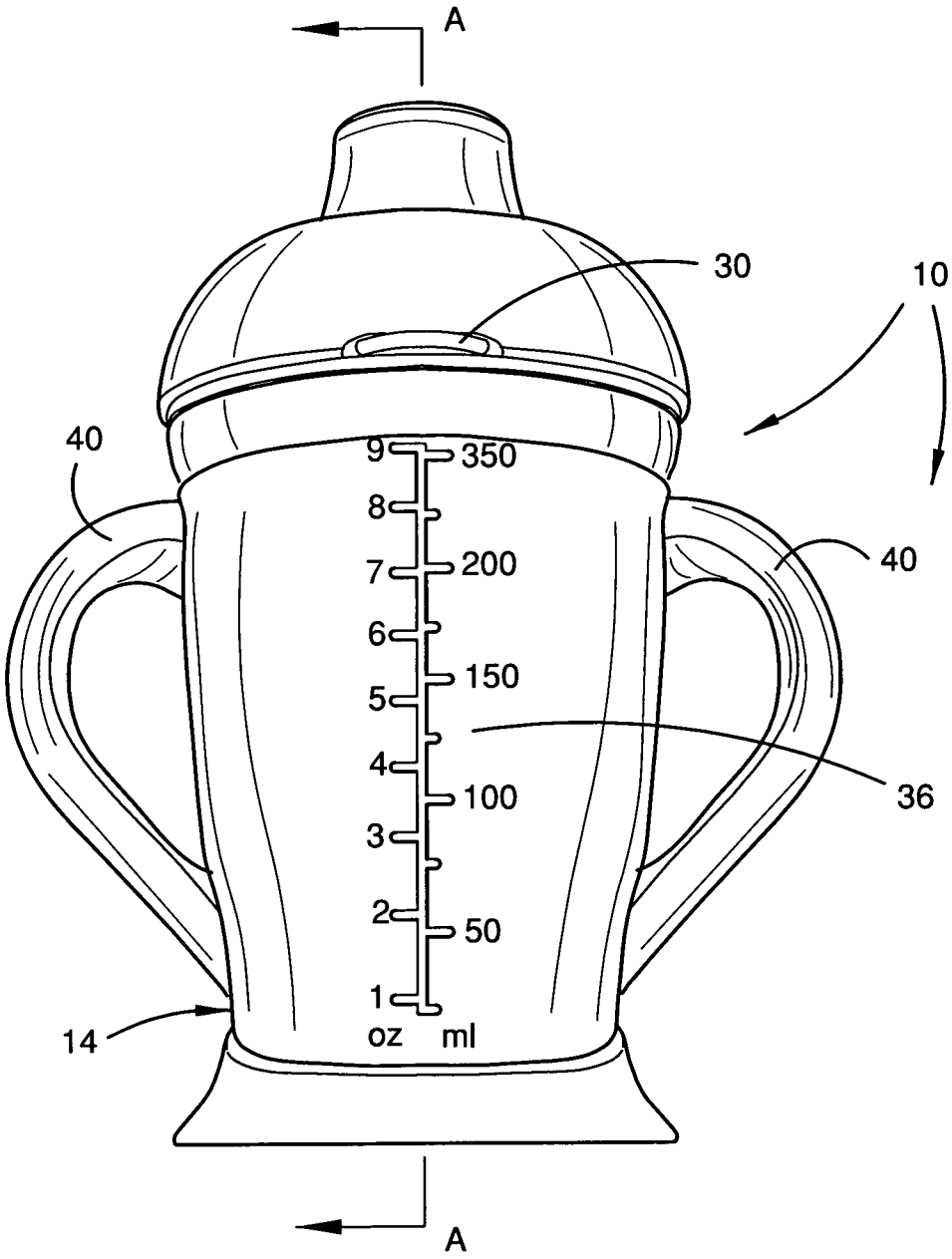
FIG. 2 is a rear view of the training cup of FIG. 1.

FIG. 2 is a rear view of the training cup 10. The container portion 14 may be transparent so the contents are visible from the outside. The rear 36 of the container wall is provided with level indicia so that the volume of the liquid can be easily ascertained. Handles 40 are integrally moulded on opposite sides of the container wall.

Considering FIG. 3, it can be seen that the forward part of the lid contains a spout 20 which is inclined so that its tip is foremost. The container wall is then shaped so that the front and rearward portions of the container wall are inclined forwardly. Put another way, the container has a cylindrical wall with a central longitudinal axis. When the cup 10 is seated on its base portion 16 on a level surface, the central longitudinal axis extends at a leaning angle (acute) to true vertical. Furthermore, the handles 40 are also inclined in the same or similar orientation to the central longitudinal axis. This inclination assists the child in orienting the spout towards the child's lips and assists in the co-ordination of grabbing the handles 40, lifting and tipping the cup 10 and inserting the spout 20 into the child's mouth. The spout 20 might be arranged at the same or similar angle to the central longitudinal axis.

Figure 4:
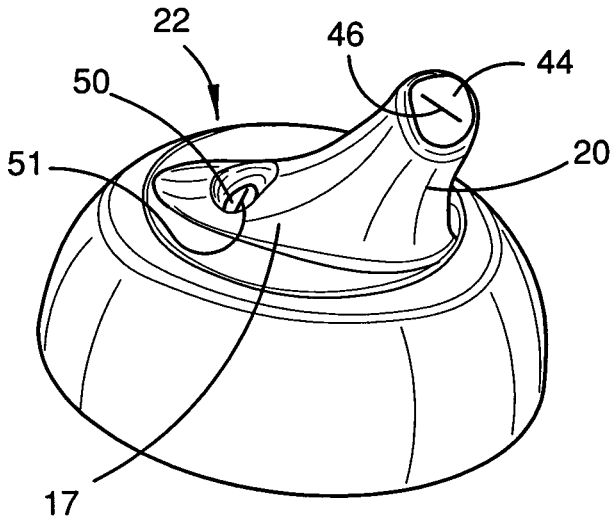
FIG. 4 is a top perspective view of the lid of the training cup.

As shown in FIG. 4, the upper end of the spout 20 is provided with a flat, planar membrane 44. The membrane 44 is thinner and thus more flexible than the remainder of the dispensing portion 17. The membrane 44 includes a slit 46 providing a liquid opening. Normally, the facing walls of the slit 46 abut each other providing a liquid seal. However, when the side walls of the spout at opposite ends of the slit 46 are pressed together in the child's mouth, the slit 46 is opened thereby providing a liquid outlet.

The air inlet 22 comprises a similar type of self-closing slit valve. In a similar fashion to membrane 44, an air valve membrane 50 is provided, which is thinner and thus more flexible than the surrounding dispensing portion 17. The membrane 50 has a slit 51 which has its length direction oriented transversely to the length direction of slit 46.

Figure 5:
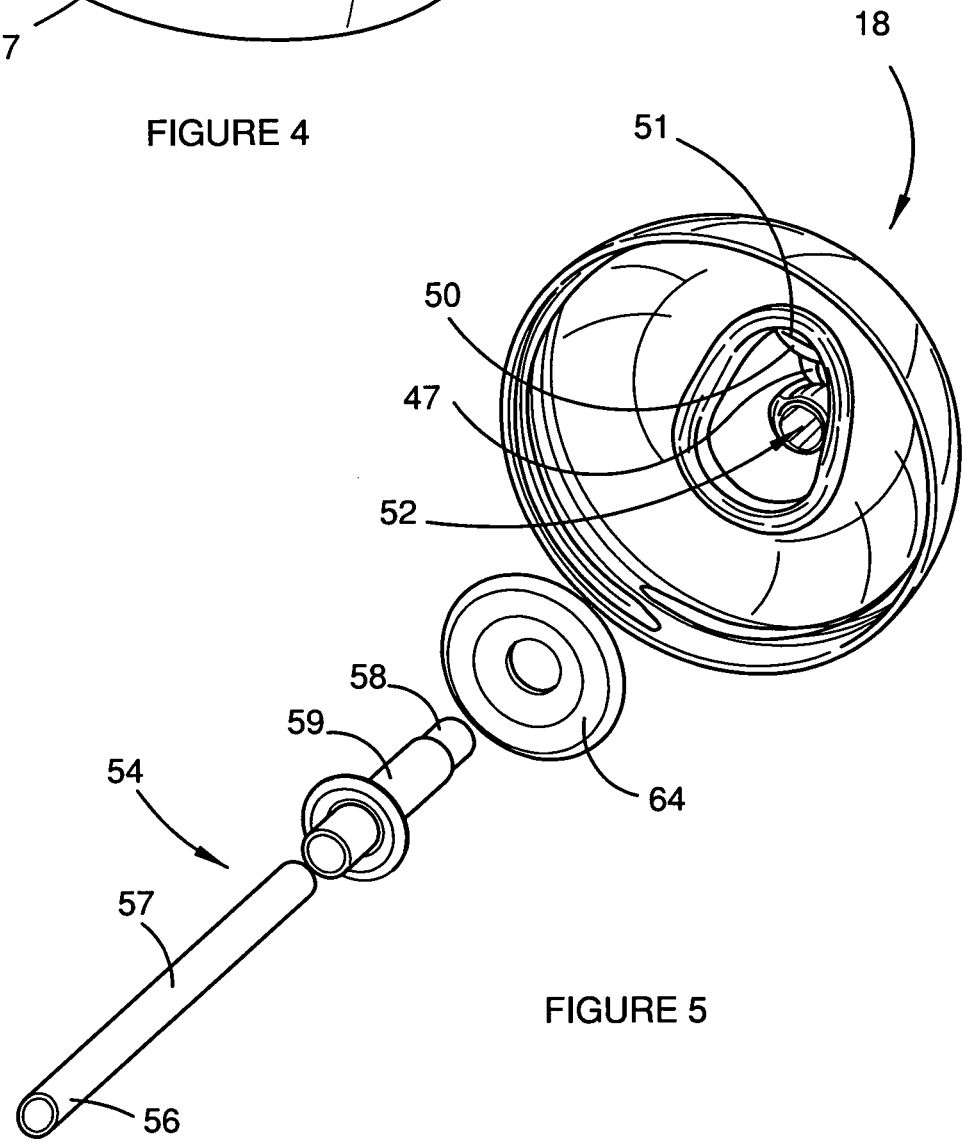
FIG. 5 is an underside perspective view of the lid of FIG. 4 together with the conduit portion in exploded form.

Referring to FIG. 5, it can be seen that the spout 20 incorporates a recess 52 in which is received a conduit portion 54 in the manner shown in FIG. 3. The conduit portion 54 is in the form of a two-part straw or tube having a first lower portion 57 having first lower end 56 and a second upper portion 59 having second upper end 58. The second upper end is received in the recess 52. The two parts 57, 59 of the straw may be separable along with the valve member 64 and the whole assembly may be separable from the lid portion 18. This facilitates cleaning especially in regard to milk based drinks and pulpy juices. The upper end 53 of the conduit portion 54 does not extend to the top of the recess 52 (as per schematic FIG. 6). This provides an upper zone 60 which is free of the conduit portion 54 so that the spout 20 may still be mechanically deformed in order to open the liquid outlet valve 46. The recess 52 may be defined by a dependent cylindrical wall 62. The conduit portion 54 may be removably received in the recess 52. This enables the conduit portion 54 to be removed for separate cleaning. Alternatively, the conduit portion 54 could be affixed or integrally moulded to the spout 20. Preferably the conduit portion has a large inner bore size for ease of cleaning.

Figure 6:
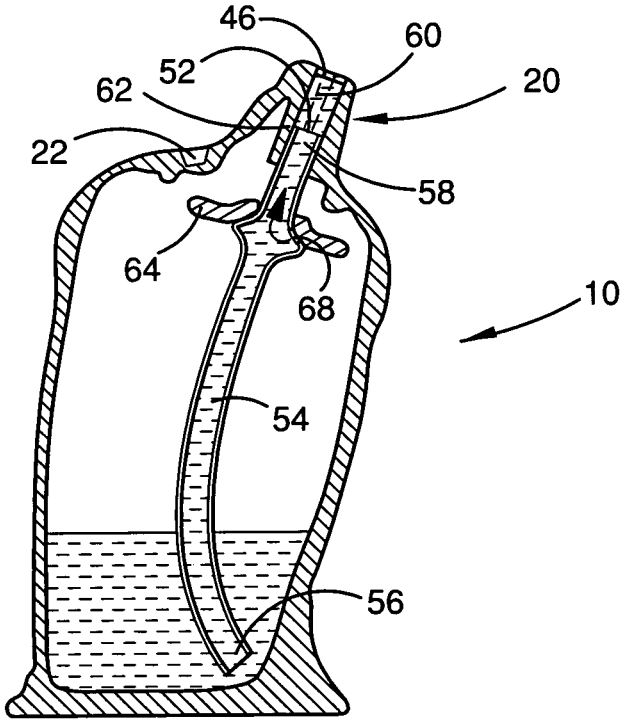
FIG. 6 is a schematic cross-sectional view of the training cup of FIG. 3 in the upright orientation.

FIG. 6 shows that the conduit portion may be arcuate and the first lower end extends forwardly of the cup 10. This maximises the range of drinking angles at which the cup may be oriented, in order that liquid may still be drawn through the lower end 56 of the conduit portion 54.

Figure 8A:
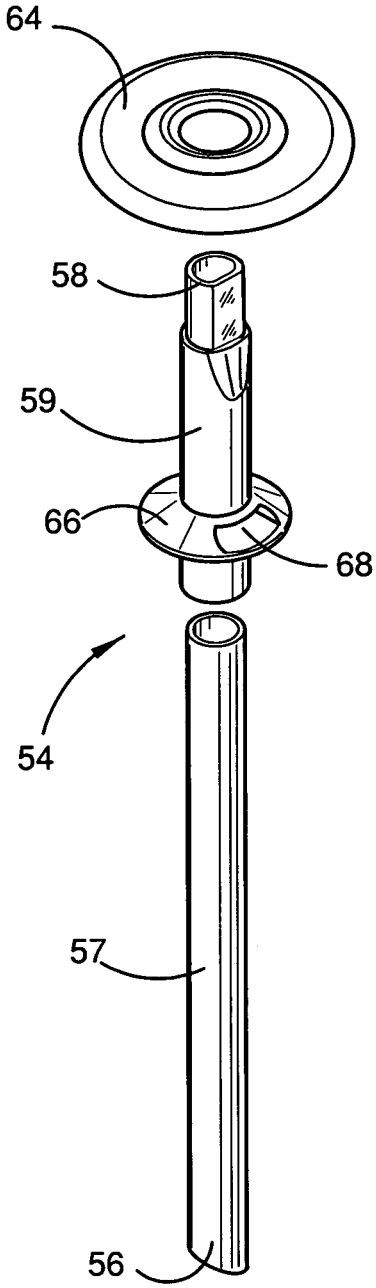
FIG. 8A is an exploded view of the conduit portion forming part of the training cup of FIG. 6.
Figure 8B:
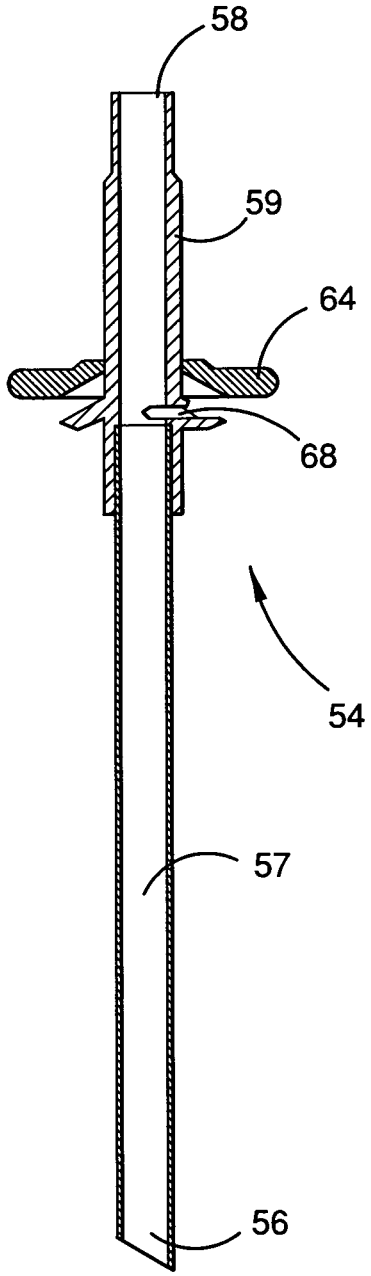
FIG. 8B is a longitudinal sectional view of the conduit portion shown in FIG. 8 A.

FIGS. 8A and 8B show the conduit portion 54 in greater detail with a flow controlling valve member 64. The conduit portion 54 comprises a two-part blow moulded straw wherein the second upper portion 59 has a valve seat 66 between the first lower end 56 and the second upper end 58. The valve seat 66 is disposed about one quarter along the length of the conduit portion from the second upper end 58. The upper one of these faces against which the valve member 64 seats is provided with an intermediate inlet 68 (or a number of intermediate inlets). In the seated orientation of the cup 10 shown schematically in FIG. 6, the intermediate inlet 68 is closed off by the annular valve member 64. The annular valve member 64 has a significantly higher specific gravity than water and is preferably of moulded acetal. The underside of the valve member 64 is commensurate in shape with the upper face of the valve seat 66 so as to close off the intermediate inlet 68 when the valve member 64 is seated on the intermediate portion 36 (as per FIG. 3).

Thus, when the cup 10 is oriented in the seated position shown in FIG. 6, the valve member 64 will be seated against the valve seat 66 by gravity. With liquid in the cup, when the user applies suction to the spout 20, this will tend to draw the valve member 64 further closed against the intermediate inlet 68, thereby creating a vacuum seal and enabling the drawing of liquid through the lower end 56 of the conduit portion 54. Thus, in this orientation, the conduit portion 54 will function as a normal straw.

Figure 7:
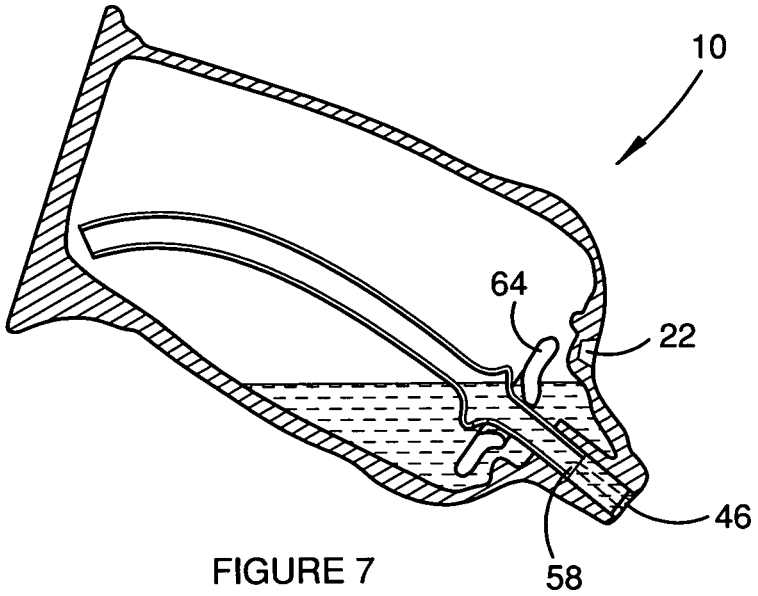
FIG. 7 is a schematic view corresponding to FIG. 6, except in the inverted orientation.

However, with reference to FIG. 7, if the cup 10 is inverted, the valve member 64 will tend to sink under the action of gravity, moving towards the second end 58 of the conduit portion 54, thereby opening the intermediate inlet 68. The action of the liquid in the cup flowing from the base of the cup towards the mouthpiece will also serve to dislodge the valve member 64 thereby breaking the vacuum seal or surface tension seal. Accordingly, with the intermediate inlet opened, the liquid will flow through the intermediate inlet 68 and can be drawn by the user out the spout 20 by applying suction and light mechanical pressure to the spout 20. In both the actions of FIG. 6 and FIG. 7, mechanical deformation of the spout will effect opening of the air inlet 22.

Having regard to FIG. 3, it can be seen that the intermediate inlet 68 is open towards the forward side of the vessel. Thus, this vessel works best when the drinking vessel is rotated about a horizontal axis perpendicular to the forward/rearward plane. When rotated in this manner, the intermediate inlet 68 is submerged in any liquid contained in the drinking vessel. This provides optimal liquid flow since the intake of air through non-submerged inlets is avoided. Thus, this drinking vessel is optimally used by being tipped in the aforesaid direction.

The annular valve member 64 preferably has a specific gravity which is significantly higher than 1.0 such that when in the upright orientation of FIG. 6, gravity will assist the sealing of the valve member 64 to its valve seat 66.

Likewise, when using the drinking vessel in an inclined or upturned orientation, the specific gravity of the valve member 64 assists the opening operation on account of being significantly heavier than the liquid in which it is or will become partially or wholly submerged. A higher specific gravity can also help break any surface tension seal created by liquid present between the valve member 64 and its valve seat.

As shown in FIG. 8A, the upper end 58 of the conduit portion 54 may be of non-circular shape, such as a D section with a complementary recess 52 provided in the spout 20, in order to orientate the conduit portion 54 with the intermediate inlet 68 facing forwardly.

Furthermore, it can be seen in FIG. 8B that the valve member 64 extends laterally beyond the outer periphery of the intermediate portion 66. Thus, when the drinking vessel is inverted, the liquid flow can act against the valve member 64 to help break any vacuum seal or surface tension seal between the valve member 64 and its valve seat 66.

Preferably the container 10, conduit portion 54 and the associated valve member 64 are constructed from dishwasher safe, food grade material, e.g. appropriate plastics, metals, ceramics. The materials used are preferably also suitable for hot and cold beverages.

Figure 8C:
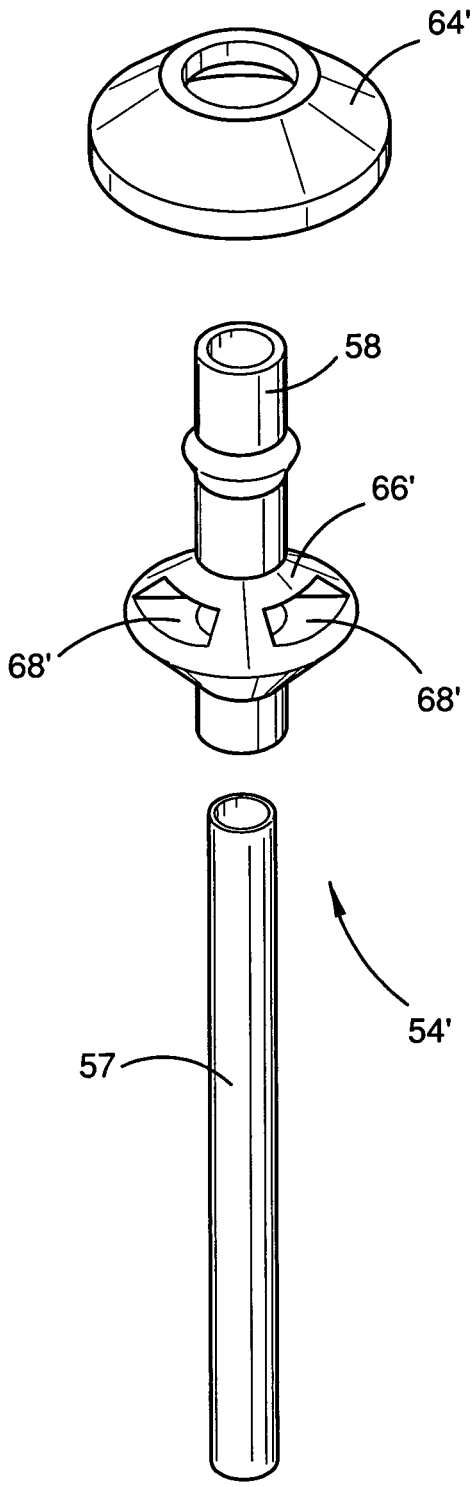
FIG. 8C is an exploded view of a first alternative conduit portion.

A first alternative embodiment of the conduit portion 54' is shown in FIG. 8C. This is similar in many respects and like numerals thus represent like parts with the addition of a prime symbol (') to show where parts have been adapted for the new embodiment. The valve seal 66 is provided with a plurality of arcuate inlets 68'. Additionally, the upper end 58 is circular such that the conduit portion 54' may be assembled with the spout 20 in any orientation. In this embodiment, the drinking vessel may be inclined in any orientation and flow will occur through some or all of the intermediate inlets 68'.

Figure 8D:
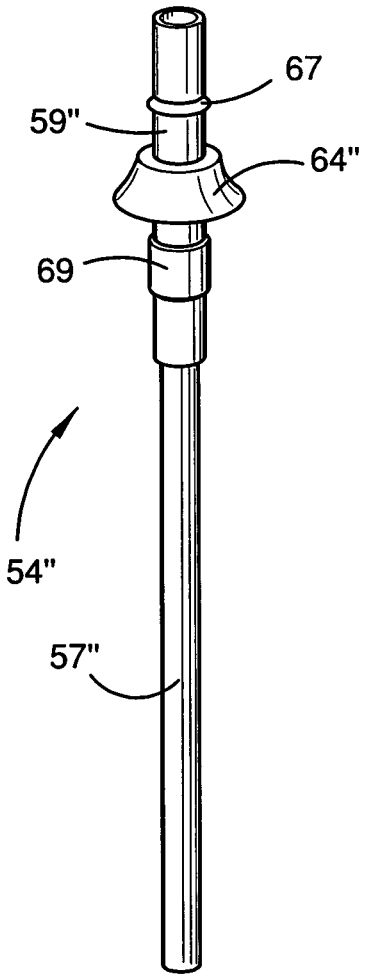
FIG. 8D is an assembled side a first of a second alternative conduit portion.
Figure 8E:
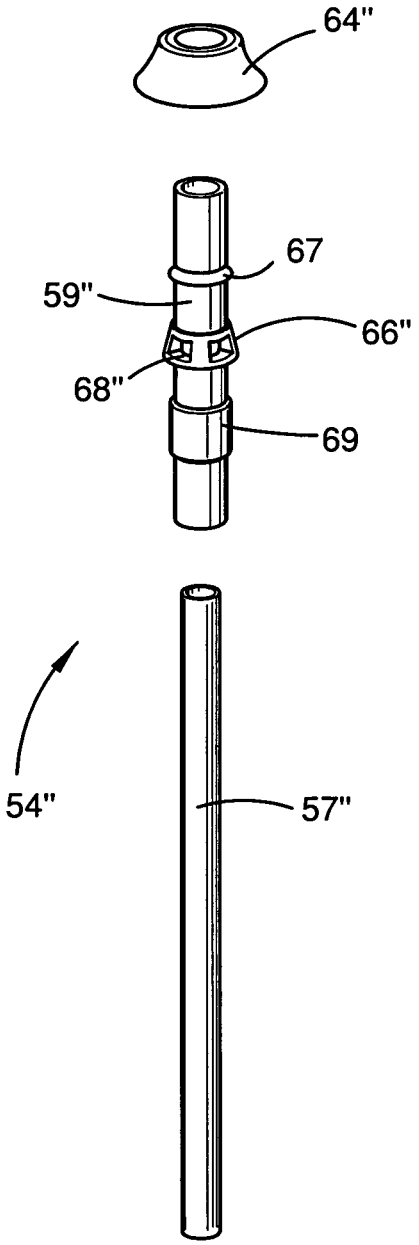
FIG. 8E is an exploded side view of the second alternative conduit portion shown in FIG. 8D.
Figure 8F:
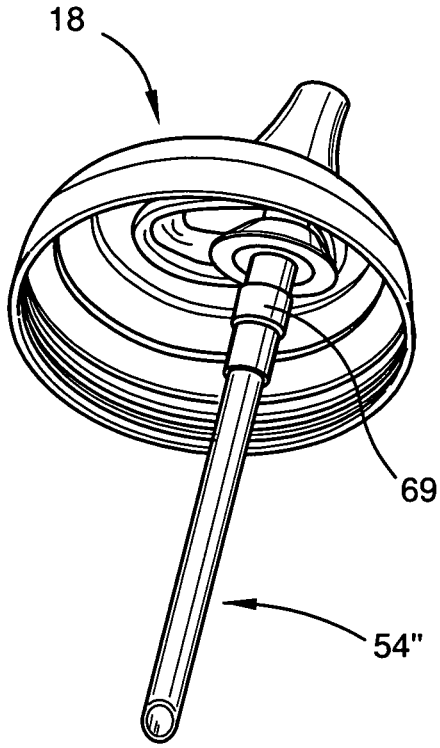
FIG. 8F is an underside perspective view showing the lid assembled with the second alternative conduit portion of FIG. 8D.

FIGS. 8D to 8F illustrate a second alternative embodiment of the conduit portion 54". This conduit portion 54" is similar in many respects to the previous two embodiments and accordingly like numerals represent like parts, except with the addition of prime symbol (') to show where parts have been adapted for the new embodiment.

Like the previous embodiments, the conduit portion 54" is in the form of a two part straw or tube having a lower portion 57" and an upper portion 59". The upper portion and the lower portion are separable for separate cleaning. The upper portion 59" is provided with a valve seat 66" having an upper surface which is frusto-conical in form. The upper surface of the valve seat 66" is provided with a plurality of evenly spaced, circumferentially arranged inlets 68". The inlets 68" communicate with the conduit within the upper portion 59".

The valve member 64" is in the form of a frusto-conical shell having a lower face which is complementary to the shape of the valve seat 66" so that the valve member 64" can seat against the upper surface of the valve seat 66" and thereby close the inlets 68".

The upper portion also includes an upper stop 67 in the form of a circular rib on the outer surface of the upper portion 59". The upper stop 67 defines the upper limit of movement for the valve member 64" so that the valve member 64" will not become separated from the upper portion 59" and lost.

The upper portion 59" also includes a gripping portion 69 in the form of a boss. The gripping portion 69 assists with insertion of the conduit portion 54" into the spout 20 and removal therefrom as depicted in FIG. 8F.

Figure 9:
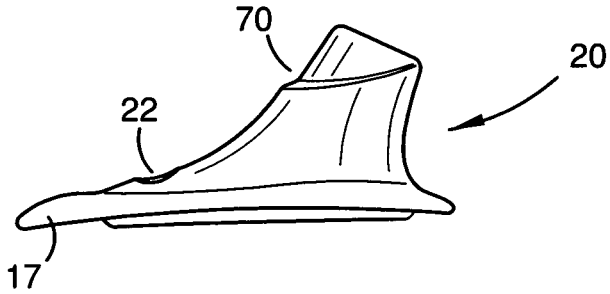
FIG. 9 is a detailed view of the mouthpiece or spout forming part of the training cup of FIG. 6.

FIG. 9 is a more detailed view of the dispensing portion 17 which incorporates the spout 20 and surrounds the air inlet 22. The spout 20 defines a lip seat 70 to guide the position of the user's lips. When the user applies light mechanical pressure at this location, then the upper end of the spout 20 will deform in order to open the liquid outlet valve 46. The liquid outlet valve 46 may be linked by means of an internal rib 47 (see FIG. 5) to the air inlet 22 such that when the upper end of the spout 20 is deformed, the air inlet 22 also opens. However, the air inlet 22 is optional since it has been found that semi rigid and flexible bottles/containers work best without the air inlet 22 (because the deformed bottle sucks in air to equalise the pressure). Rigid bottles and containers work best with the air inlet 22, because air cannot get in quickly enough to relieve the vacuum.

FIGS. 10 to 17 show a second embodiment of the infant cup 10'. The form of the cup 10' is similar in many respects to the training cup illustrated in FIGS. 1 to 9. Accordingly, the same reference numerals will be used to represent parts which are the same. Where parts have undergone modification to adapt to the new embodiment, such parts will be represented by the same number accompanied by a prime symbol (').

Figure 10:
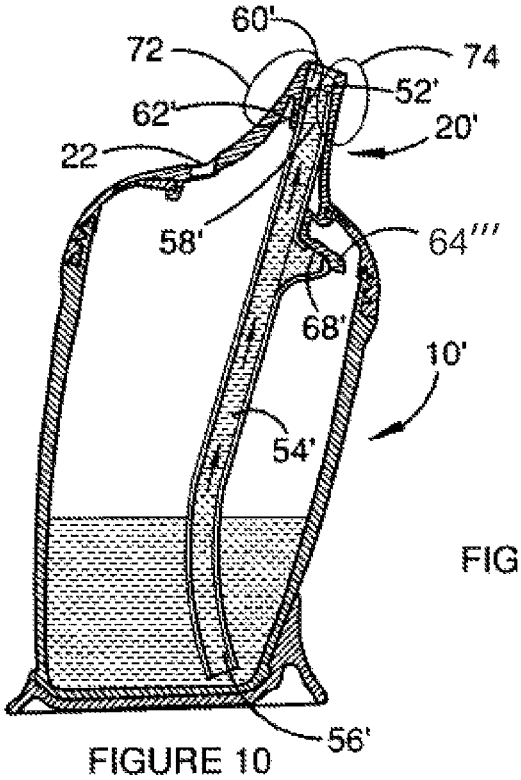
FIG. 10 is a schematic cross-sectional view of a training cup according to a second preferred embodiment of the present invention.

Referring to FIG. 10, the spout 20' in this embodiment has been modified somewhat. Firstly, the spout portion 20' now includes a flexible rear portion 72 and a rigid front portion 74. This ensures that the deformation of the spout 20' takes place at the rear 72 which ensures opening of the air inlet 22 on deformation of the spout 20' as with the previous embodiment, Secondly, in this embodiment, the valve member 64''' is integrally moulded with the dispensing portion 17' which can be seen most clearly in FIGS. 14 and 15.

Figure 11:
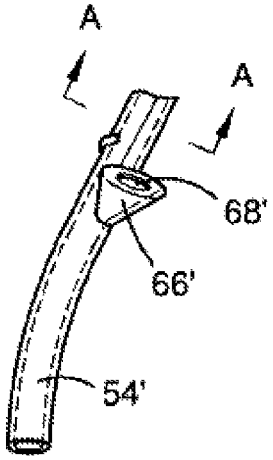
FIG. 11 is a detailed view of the conduit portion forming part of the training cup of FIG. 10.
Figure 13:
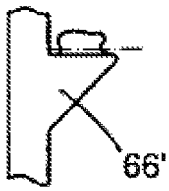
FIG. 13 is a detail of the conduit portion of FIG. 11 showing a manufacturing step.
Figure 14:
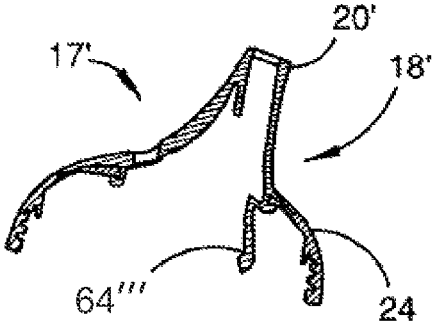
FIG. 14 is a cross-sectional view of a lid forming part of the cup shown in FIG. 10.
Figure 15:
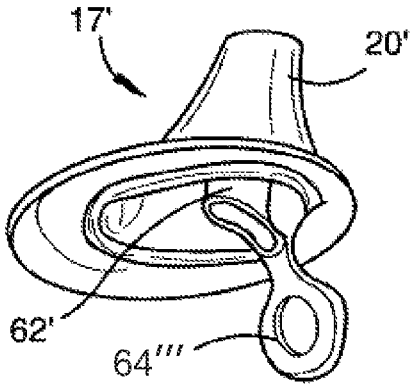
FIG. 15 is an underside perspective view of the lid shown in FIG. 14.

Referring to FIG. 11, the form of the conduit portion 54' has been modified so that the valve seat 66' is no longer arranged with its central axis coincident with the central axis of the main conduit. Instead, the valve seat 66' in the form of bulbous portion is formed like a branch extending from the main conduit. At the upper end of the, the intermediate inlet 68' is formed. FIG. 13 illustrates how the conduit portion 54' may be formed by blow moulding with the top of the valve seat 66' intact. In a subsequent step, the top of the valve seat 66' is trimmed off to form the intermediate inlet 68'.

Figure 12:
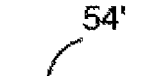
FIG. 12 shows the cross-sectional shape of the conduit portion of FIG. 11.

The conduit portion 54' is removably received within the recess 52' defined within the spout 20'. The upper end 58' of the conduit portion and the recess 52' may have complementary cross-sections which are non-circular to ensure that the conduit portion 54' is inserted into the spout 20' in the correct orientation. FIG. 12 shows an appropriate D section for this purpose. Further, the lip seat 70, shown in FIG. 17 may have a correspondingly shaped internal seat to provide a seat for the upper end 58' of the conduit portion 54'.

Referring to FIG. 10, when the conduit portion 54' is inserted into the spout 20' in the correct orientation, the valve member 64' will be flexed away from its dependent orientation so as to cover the intermediate inlet 68'. This closes off the intermediate inlet 68' and enables liquid to be drawn from the first lower end 56' to the spout 20'.

Figure 16:
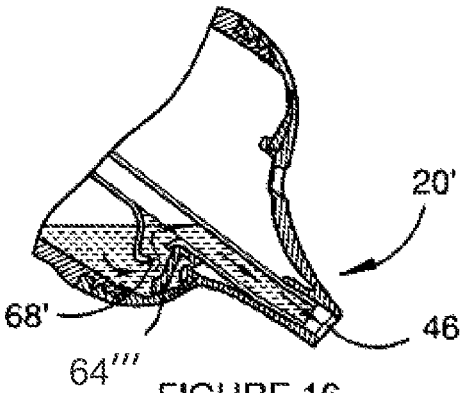
FIG. 16 is a partial cross-sectional view corresponding to FIG. 10, except showing the cup in the inverted position.
Figure 17:
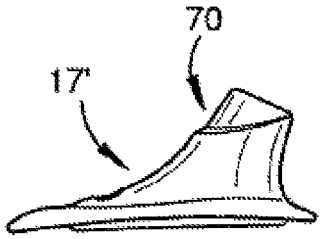
FIG. 17 is a detailed view of the dispensing portion forming part of the lid shown in FIG. 14.

On the other hand, when the cup 10' is inverted as shown in FIG. 16, the valve member 64''' will tend to sink under the action of gravity and the urging of the liquid as it flows towards the mouthpiece 20'. By applying a light mechanical pressure to the mouthpiece 20' combined with suction, the user can open the liquid outlet 46 to draw liquid through the intermediate inlet 68'. The invention thus enables the cup 10' to be used at a range of different orientations.

Certainly, the flap valve member 64''', along with the spout portion 20' is constructed of an elastomeric material. The flap valve member 64''' takes advantage of the spring memory characteristics of this material to aid in the valve operation by biasing the valve member 64''' to return to the sealing position in the upright orientation.

Figure 18:
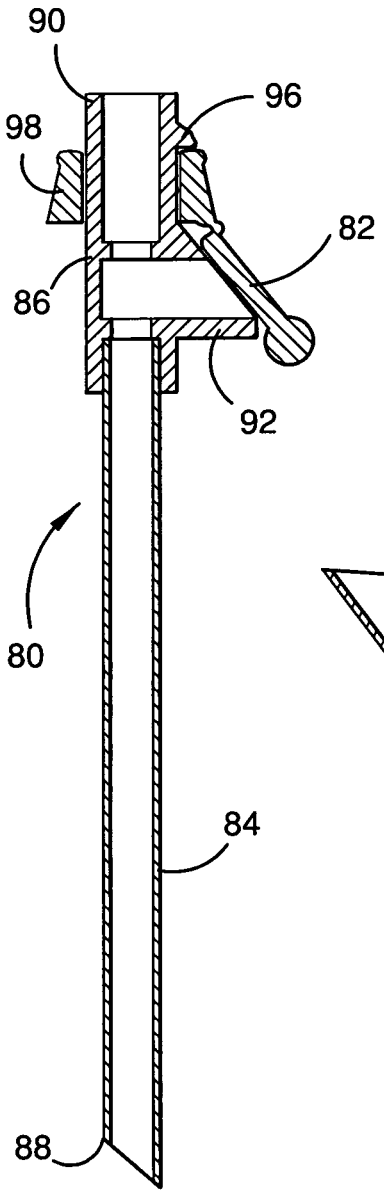
FIG. 18 is a schematic cross-sectional view of another embodiment of the conduit portion disposed in the upright configuration.

FIG. 18 shows an alternative form of a conduit portion 80, which like the embodiment shown in FIG. 10 has a flap 82 functioning as a valve member. The conduit portion 80 comprises a first lower portion 84 and a second upper portion 86. The lower portion 84 has a first lower end 88 through which liquid may be drawn into the conduit portion 80 in the upright orientation as per previous embodiments. The second portion 86 has an upper end 90 which is inserted into the recess 52 as per previous embodiments.

Figure 19:
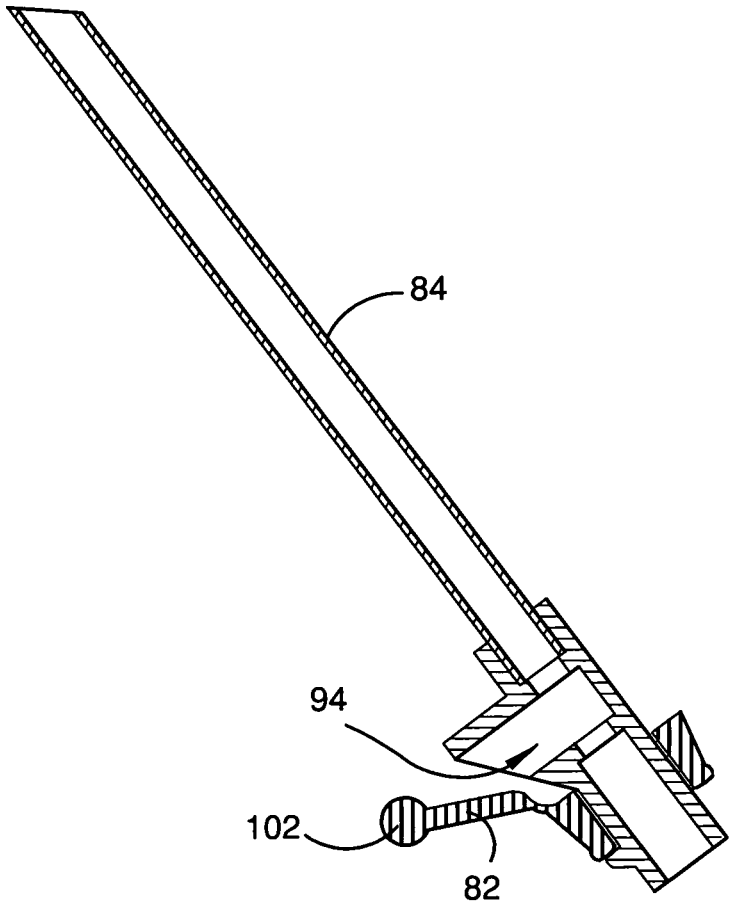
FIG. 19 is a view similar to FIG. 18, except shown in the upturned configuration.
Figure 20:
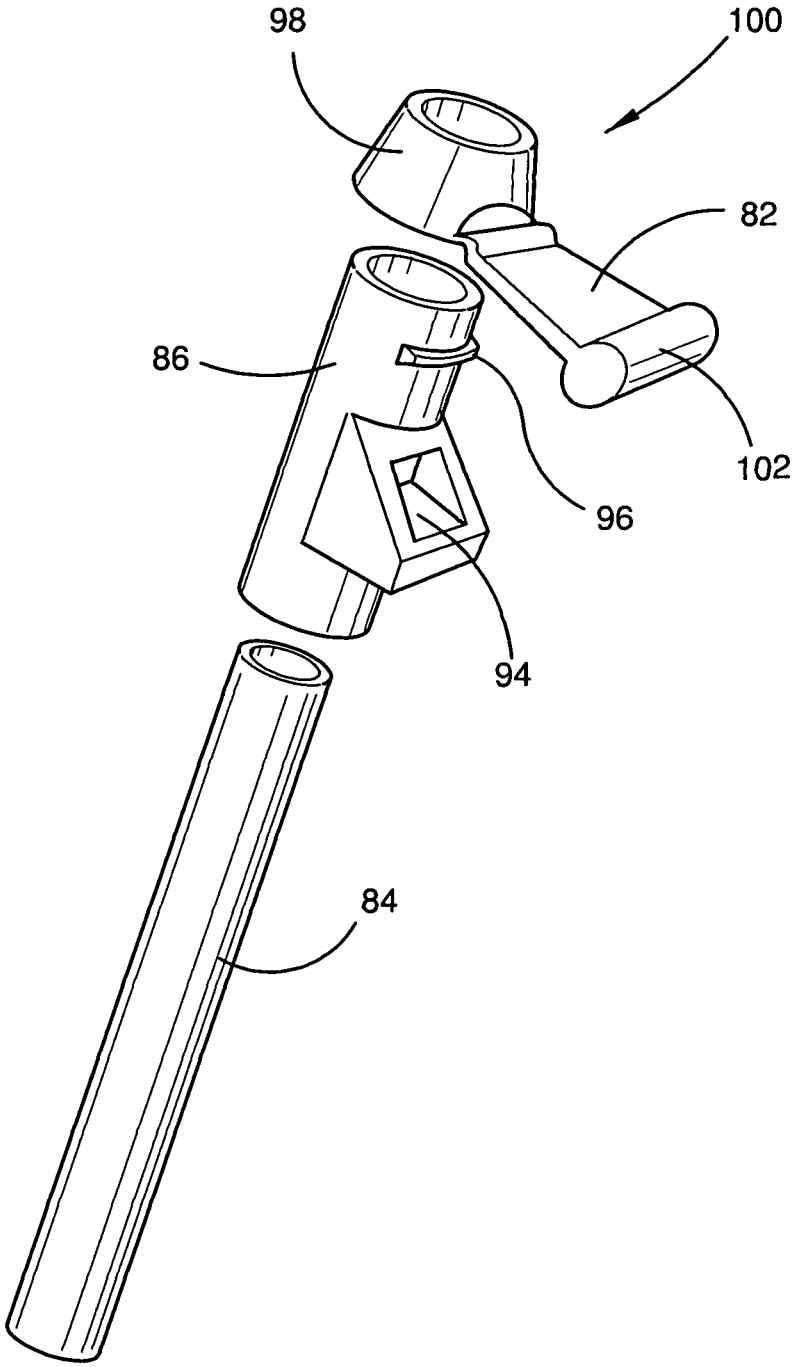
FIG. 20 is an exploded perspective view of the conduit portion of FIG. 18.

Like the embodiment of FIG. 11, the second portion 86 may be formed as a branch 92 extending from the main conduit to form the intermediate inlet 94. The second portion is also provided with a location rib 96 above the branch 92 as can be seen in FIG. 20. The location rib 96 serves to locate an annulus 98 which forms part of an integral valve component 100 which incorporates the flap valve member 82. The integral valve component 100 may be constructed of elastomeric material such as rubber to enable it to be fitted over the location rib 96. The flap valve member 82 may be provided with a bulbous lower edge 102 to function as a weight. Thus, when the conduit portion 80 is in the upturned configuration as shown in FIG. 19, the weighted edge 102 will assist with opening of the flap valve member 82. The lower portion 84, upper portion 86 and valve component 100 may be separable for cleaning as shown in FIG. 20.

The following embodiments depicted in FIGS. 21 to 27 show various different types of bottles which use either the annular valve member 64 of the type from FIGS. 1 to 9 or the flap type valve of the type from FIGS. 10 to 20. Each container type could be used with either the annular valve type or the flap valve type. Additionally, the valves could be scaled up to suit larger capacity applications.

Figure 21:
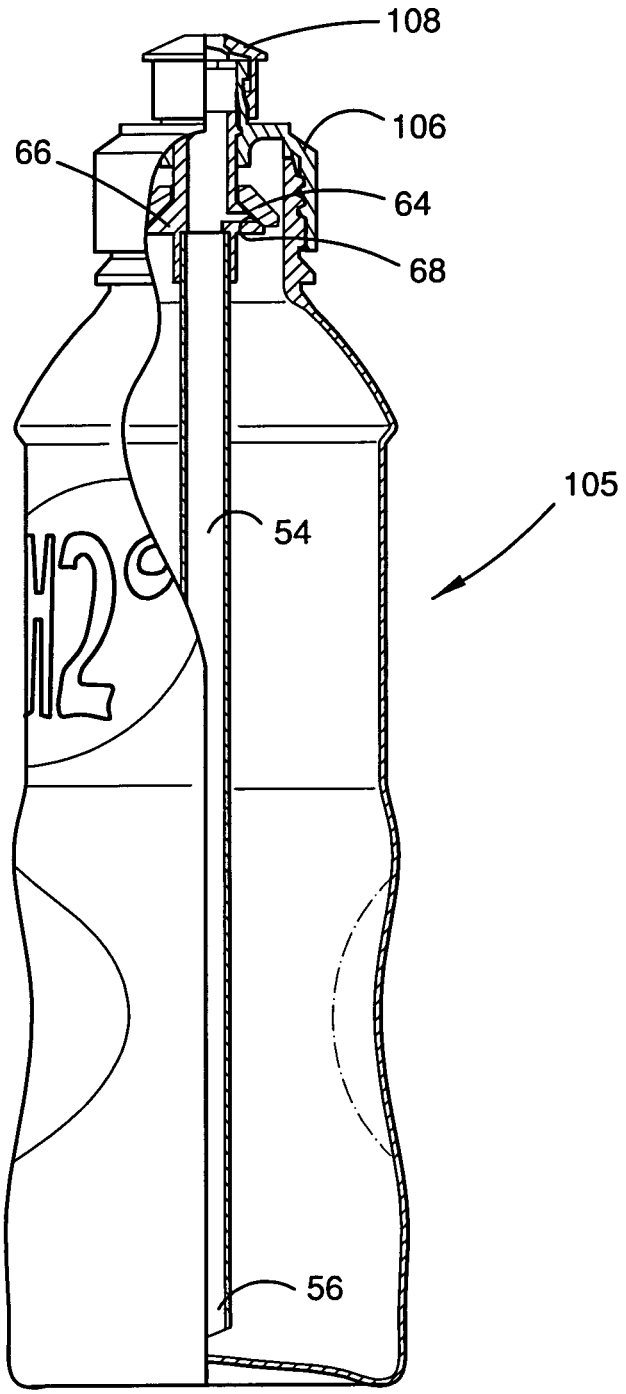
FIG. 21 is a part sectional view of another embodiment of a drinking vessel according to the present invention.

FIG. 21 shows a "pop top" disposable or reusable drink bottle 105 which incorporates the conduit portion 54 shown in FIG. 6. The drink bottle has a screw closure 106 which threadingly engages with the top of the bottle. The screw closure 106 incorporates a popup closure 108, the form of which will be familiar to those skilled in the art. When the popup closure is in the lowered configuration, the bottle 105 is closed. When the user wishes to drink from the bottle, he lifts the popup closure 108. By sucking on the popup closure 108, the user can draw liquid through the lower opening 56 of the conduit portion 54. As with other embodiments, if the user then inverts the bottle 105, he can draw liquid through the intermediate opening 68. The bottle can also function as a squeeze bottle. When the user squeezes the side walls of the bottle 105, this assists in expressing the contents from the bottle.

Figure 22:
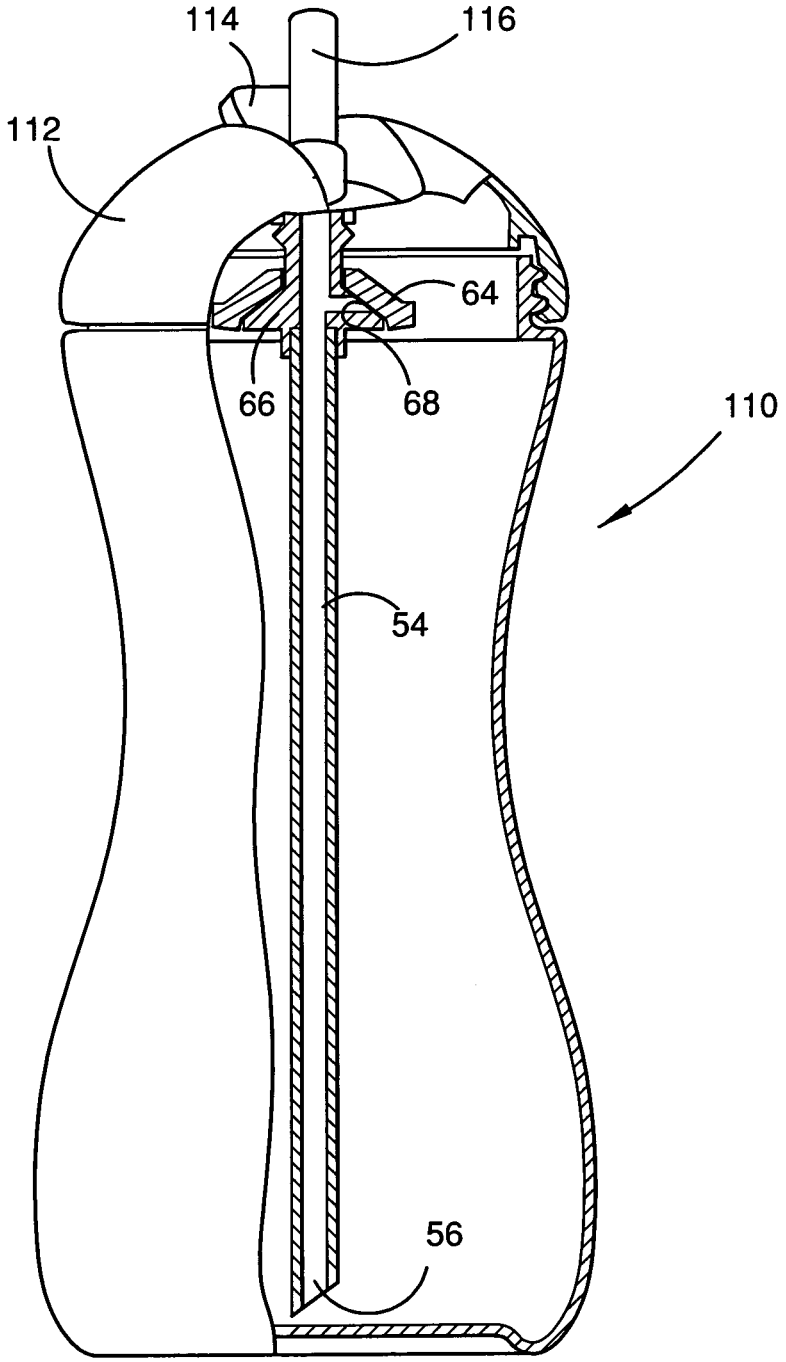
FIG. 22 is a part sectional view of another embodiment of a drinking vessel according to the present invention.

FIG. 22 shows another drink bottle which incorporates the conduit portion 54 shown in FIG. 6. This drink bottle 110 is provided with a screw closure 112 at the upper end as with the previous embodiment. This screw closure 112 is threadingly engaged with the upper end of the bottle 110. The screw closure 112 includes a pivotable flap 114 which when closed, conforms to the external contour of the closure 112. When open, as shown, the flap 114 reveals a flexible mouthpiece portion 116. The flexible mouthpiece portion 116 is in fluid communication with the conduit portion 54. The flexible mouthpiece portion 116 is able to be bent over and encapsulated within the screw closure 112 when the flap 114 is closed. When the flexible mouthpiece portion 116 is bent over, a seal is created by virtue of the kink in the flexible mouthpiece portion 116. This bottle 110 can also function as a squeeze bottle.

Figure 23:
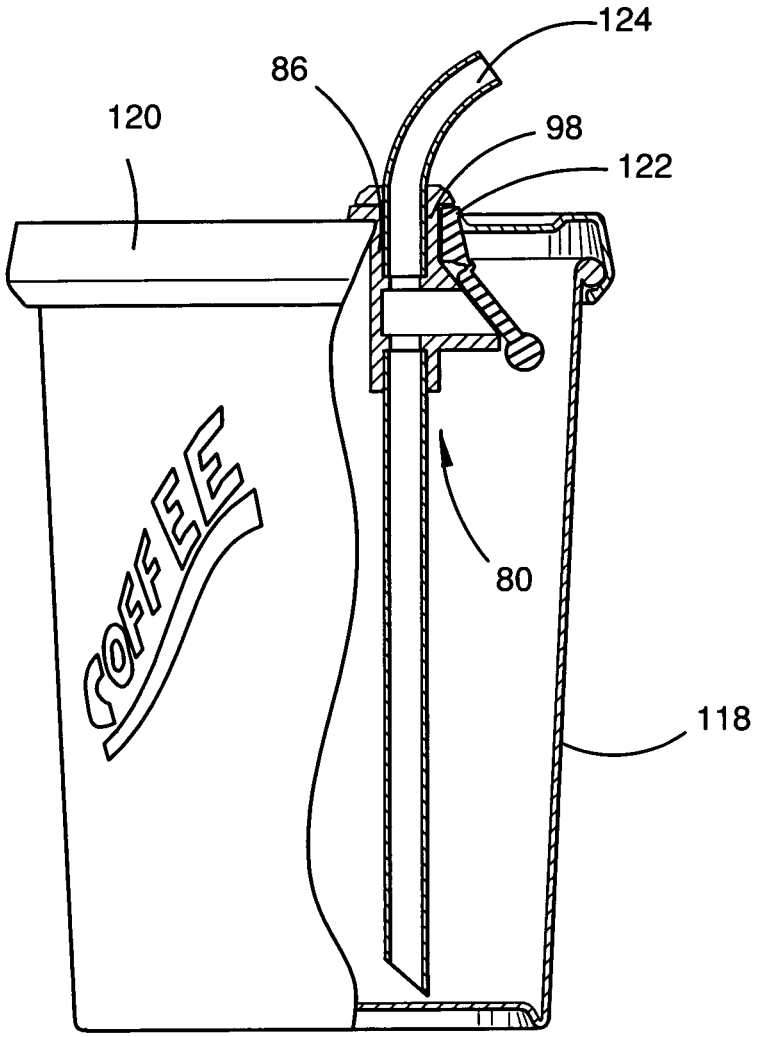
FIG. 23 is a part sectional view showing yet another embodiment of a drinking vessel in accordance with the present invention.

FIG. 23 illustrates a takeaway cup 118 with a snap-fitting lid 120 and incorporates the conduit portion 80 as shown in FIGS. 18 to 20. The resilient annulus 98 of the integral valve component 100 functions as a grommet to provide a seal with an opening 122 formed in the lid 120. Additionally, the conduit portion 80 employs a mouthpiece 124 received within the second portion 86. The mouthpiece 124 may be formed of a resilient material.

Figure 24:
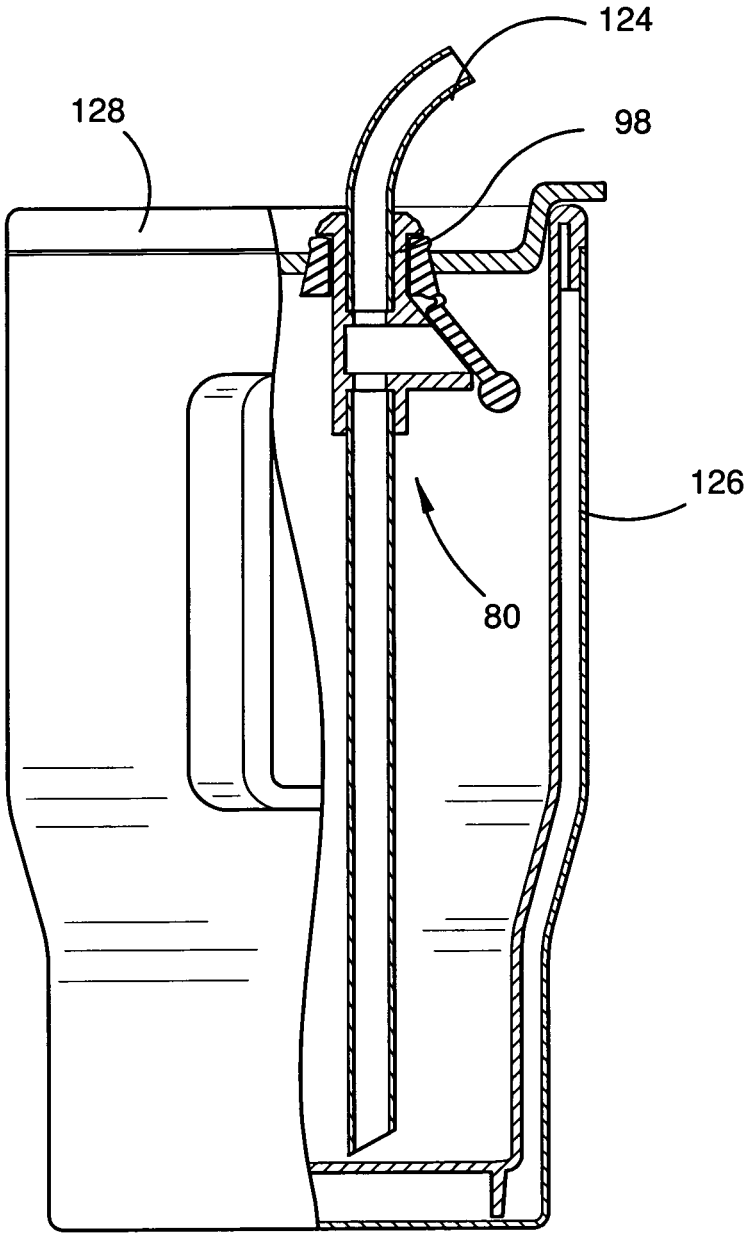
FIG. 24 is a further embodiment of a drinking vessel in accordance with the present invention.

FIG. 24 is similar in many respects to the disposable cup 118 of FIG. 23 except being an insulated mug 126 with lid 128. The conduit portion 80 is received in the lid 128 in the same fashion as the previous embodiment.

It will be understood that the containers of FIGS. 21 to 24 do not possess an outlet valve like the slit 46 of FIGS. 1 to 17. Instead, the conduit portions are essentially open-ended during normal use. Therefore, air inlet valves such as air inlet 22 of the former embodiments (FIGS. 1 to 17) are not required because air can easily enter the container once sucking has ceased.

Figure 25:
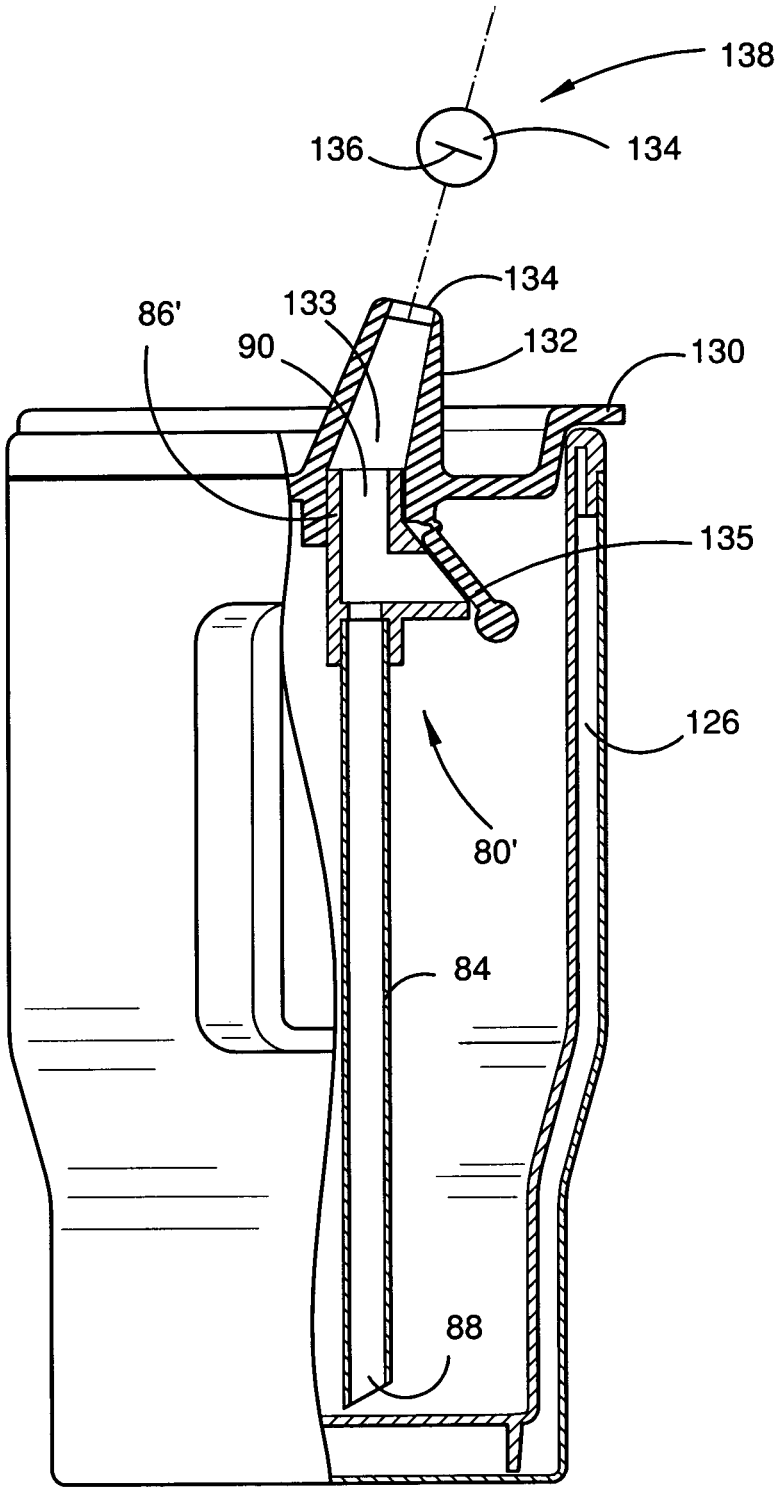
FIG. 25 is still a further embodiment of a drinking vessel in accordance with the present invention.

FIG. 25 shows an alternative form of the insulated mug 126. In this embodiment, the lid 130 is formed with an integral spout 132. The underside of the spout 132 defines a cylindrical recess 133. The lid 130 also includes an integral flap valve member 135 which depends from a forward portion of the spout 132.

In this embodiment the conduit portion 80' takes a different form from the previous embodiments in that the valve component 100 is omitted because the flap valve member 135 is integral with the lid 130 instead. The conduit portion 80' includes a first lower portion 84 with a first lower opening 88 and a second upper portion 86' having an upper end 90. The upper end 90 is received in the cylindrical recess 133 of the spout 132.

The spout 132 is provided with a self-closing slit valve 138 at its upper end. The self-closing slit valve is in the form of a planar membrane 134 at the top of the spout 132. The planar membrane 134 is provided with slit 136, the side walls of which are normally in abutting relationship to seal the spout but can be opened with light mechanical pressure applied to the side walls of the spout 132. While not shown, this embodiment may also include an air valve to permit entry of air into the mug 126 as liquid is being withdrawn. The benefit of this configuration over the previous embodiments of FIGS. 22 to 24 is that the valve 138 automatically closes and thus prevents spills if the mug 126 is advertently knocked over.

The planar membrane 134 may be integrally formed with the spout 132 as a homogenous moulding. Alternatively, the planar membrane 134 may be over-moulded into the spout 132. Preferably the lid 130 is constructed of thermoplastic elastomer.

Figure 26:
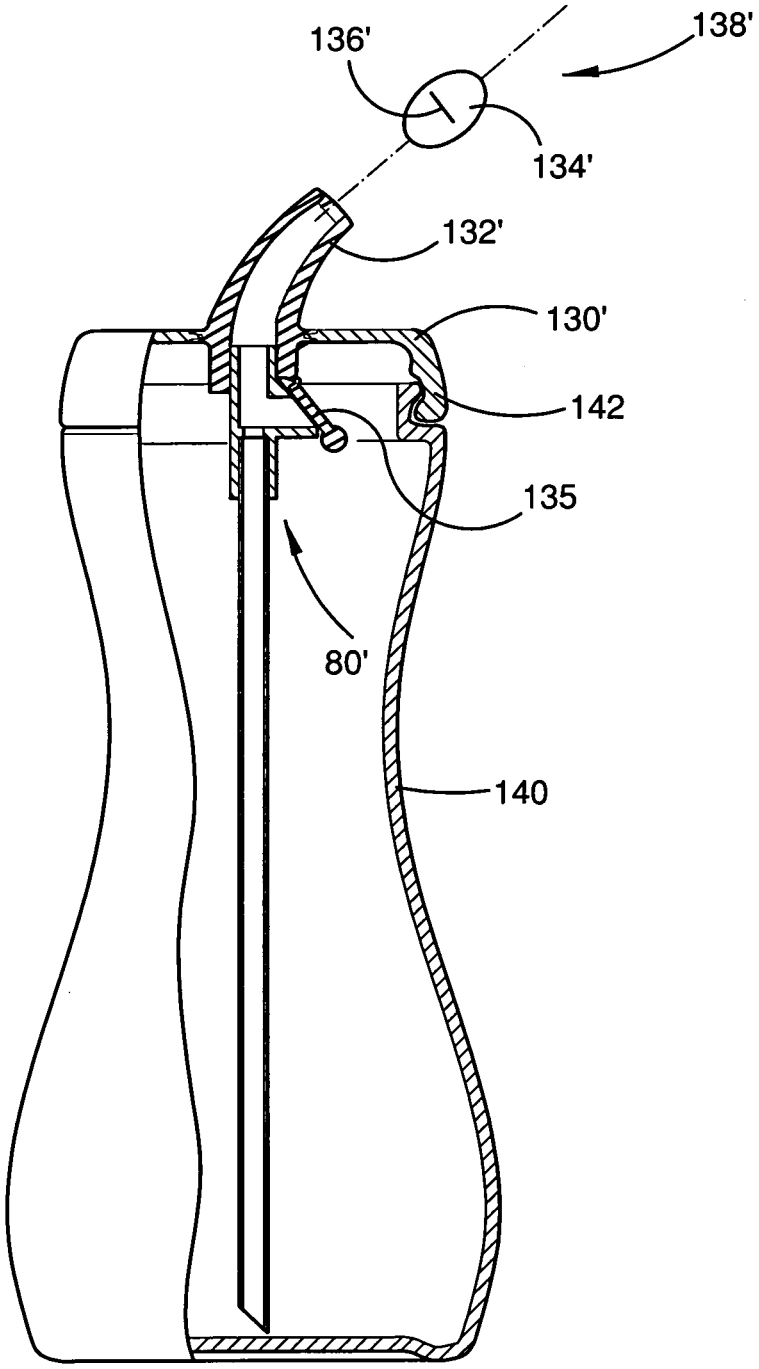
FIG. 26 is yet another embodiment of a drinking vessel in accordance with the present invention.

FIG. 26 shows an alternative form of drinking vessel 140 which is similar in many respects to the previous embodiment of FIG. 25. In this embodiment, the lid 130 has a central spout portion 132' formed of a thermoplastic elastomer which is integrally moulded into a surround portion 142 which is a more rigid material than the spout portion 132'. The spout portion 132' may be over-moulded with the surround portion 142 to form the lid 130'. The spout portion 132' is provided with a self-closing slit valve 138' in a similar form to the previous embodiment except that the planar membrane 134' is oval in shape. If the vessel 140 is rigid then an air valve (not shown) may also be provided.

Figure 27:
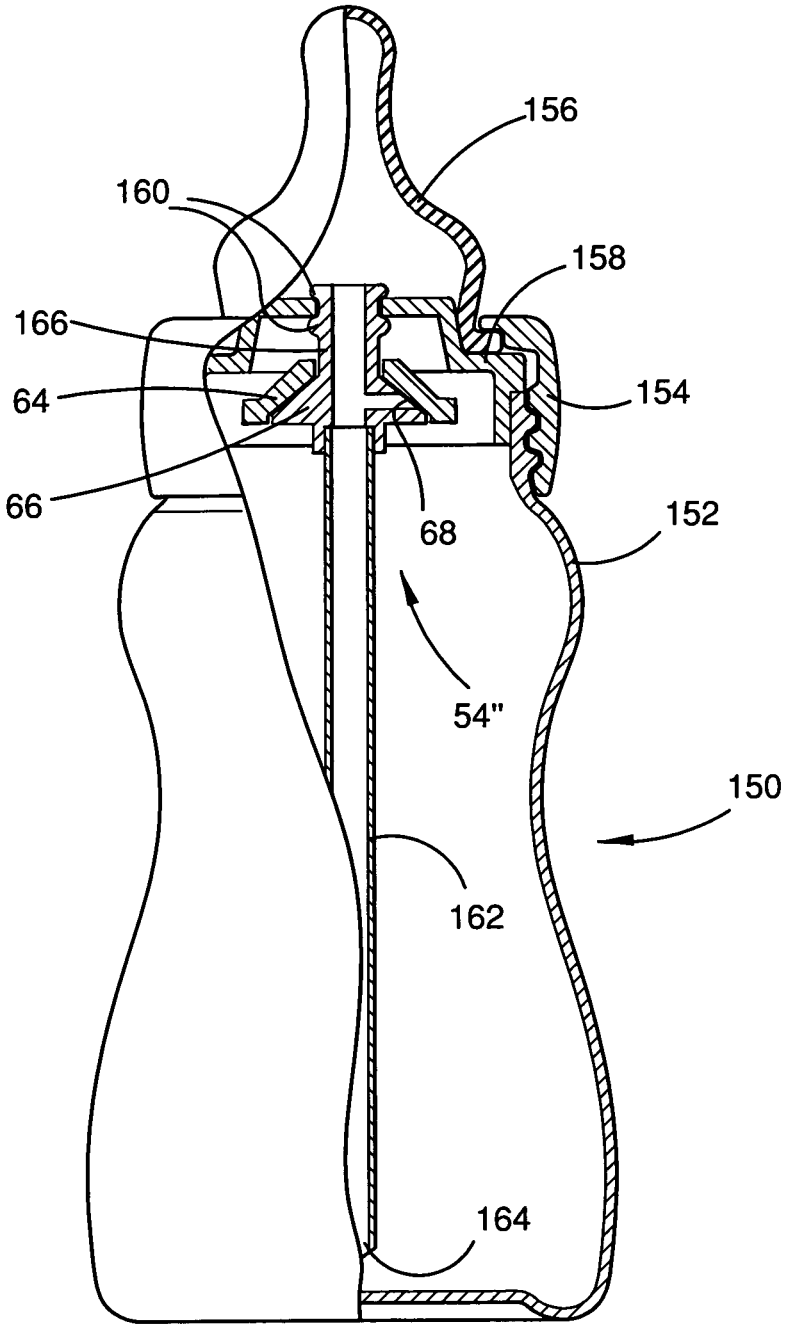
FIG. 27 is a part sectional view of a baby bottle in accordance with the present invention.

FIG. 27 illustrates a baby bottle 150 having a bottle portion 152, a closure portion 154 and a flexible rear portion 156, as is known in the art of baby bottles. The baby bottle 150 also includes an insert 158 which provides a seat for a conduit portion 54" similar in many respects to the conduit portion 54 of FIGS. 6 and 22. The conduit portion 54" has a lower first portion 162 with a first lower end 164 and an upper second portion 166 into which the first portion 162 is received. The second portion 166 includes the valve seat 66 providing the intermediate inlet 68. The valve member 64 resides on the valve seat 66 when the valve is in the closed position. The second portion 166 is different from that shown in FIG. 22 because it includes two longitudinally spaced locating rings 160 which locate the conduit portion 54" relative to the insert 158.

Thus, the baby bottle may be used in the upright configuration by sucking on the rear portion 156 so that liquid may be drawn through the lower end 164 of the conduit portion 54". Alternatively, the baby bottle 150 may be upended so that liquid will enter through the intermediate inlet 68 as explained in previous embodiments.

Additionally, an air inlet valve may be provided to enable entry of air as liquid is withdrawn. The air inlet may be separate from the liquid outlet slit (not shown) in the rear portion 156. Alternatively, the air may enter through the outlet slit provided in the rear 156.

The foregoing describes only one embodiment of the present invention and modifications may be made thereto with departing from the scope of the present invention. For example, the conduit portion 54 could be adapted to be retrofitted onto an existing sports bottle or other type of disposable drink bottle. Alternatively, an adaptor could be provided to fit the current design of conduit portion 54 onto a known drink bottle.

The claims defining the invention are as follows:

1. A lid portion for a drinking vessel, the lid portion including:

a body portion for closing an upper end of the drinking vessel, the body portion including a mouthpiece portion;

a conduit portion fluidly connected to the mouthpiece portion, the conduit portion having a distal opening through which fluid may be drawn to the mouthpiece portion;

an intermediate inlet fluidly connected to the mouthpiece portion, the intermediate inlet disposed in the conduit portion intermediate the distal opening and the mouthpiece portion;

a flow controller moveable at least under the action of gravity to control flow to the mouthpiece portion from the intermediate inlet, according to a selected orientation of the vessel; and a self-closing valve associated with the mouthpiece portion to minimize inadvertent spillage.

2. The lid portion as claimed in claim 1, wherein the mouthpiece portion is in the form of a spout which is deformable under mechanical action and the valve is in the form of a bite-activated, slit valve incorporated into the mouthpiece portion.

3. The lid portion as claimed in claim 1, wherein the mouthpiece portion is integral with the body portion.

4. The lid portion as claimed in claim 1, wherein the conduit portion is matingly engageable with an underside of the mouthpiece portion and separable therefrom.

5. The lid portion as claimed in claim 4, wherein the conduit portion comprises two or more tubular parts which are separable to facilitate manufacture or cleaning.

6. A lid portion for a drinking vessel, the lid portion including:

a body portion for closing an upper end of the drinking vessel, the body portion including a mouthpiece portion;

a conduit portion fluidly connected to the mouthpiece portion, the conduit portion having a distal opening through which fluid may be drawn to the mouthpiece portion;

an intermediate inlet fluidly connected to the mouthpiece portion, the intermediate inlet disposed intermediate the distal opening and the mouthpiece portion; and a flow controller moveable at least under the action of gravity to control flow to the mouthpiece portion from the intermediate inlet, according to a selected orientation of the vessel, wherein the flow controller includes a valve member, the position of the valve member being movable between a closed position in which the valve member is seated on a valve seat at which the valve member closes the intermediate inlet and an open position at which the valve member is spaced from the intermediate inlet, the position of the valve member being dependent on the selected orientation of the vessel, wherein the valve member has a specific gravity greater than 1.

7. The lid portion as claimed in claim 6 wherein, in the upright orientation of the vessel, the valve member rests on the valve seat under the action of gravity.

8. A lid portion for a drinking vessel, the lid portion including:

a body portion for closing an upper end of the drinking vessel, the body portion including a mouthpiece portion;

a conduit portion fluidly connected to the mouthpiece portion, the conduit portion having a distal opening through which fluid may be drawn to the mouthpiece portion;

an intermediate inlet fluidly connected to the mouthpiece portion, the intermediate inlet disposed intermediate the distal opening and the mouthpiece portion; and a flow controller moveable under the action of gravity and under the action of fluid flow in the vessel to control flow to the mouthpiece portion from the intermediate inlet, according to a selected orientation of the vessel, wherein the flow controller includes a valve member, the position of the valve member being moveable between a closed position in which the valve member is seated on a valve seat at which the valve member closes the intermediate inlet and an open position at which the valve member is spaced from the intermediate inlet, the position of the valve member being dependent on the selected orientation of the vessel, wherein the valve member is arranged, when seated, with at least a portion thereof external of the intermediate inlet and extending laterally beyond the intermediate inlet such that the valve member, when seated, is moveable under the action of fluid flow in the vessel.

9. The lid portion as claimed in claim 8, wherein the conduit portion includes a main portion and the intermediate inlet is in the form of one or more curved or annular openings surrounding the main portion of the conduit portion and the valve member is curved or ring-shaped.

10. The lid portion as claimed in claim 8, further including an aperture and wherein an upper end of the conduit portion projects through the aperture to define the mouthpiece portion.

11. The lid portion as claimed in claim 10 wherein the upper end of the conduit portion is in the form of a resilient mouthpiece portion which is closed off by folding or rotating.

12. A drinking vessel including the lid portion as claimed in claim 8.

13. The drinking vessel as claimed in claim 12 wherein the vessel further includes a container portion with an upper opening, the lid portion closing the upper opening and being separable from or hingedly connected to the container portion.

14. The drinking vessel as claimed in claim 12 further including a self-closing air inlet to allow air to enter the vessel as liquid is removed.

15. The lid portion as claimed in claim 8, wherein the intermediate inlet is disposed in the conduit portion.

16. A lid portion for a drinking vessel, the lid portion including:

a body portion for closing an upper end of the drinking vessel, the body portion including a mouthpiece portion;

a conduit portion fluidly connected to the mouthpiece portion, the conduit portion having a distal opening through which fluid may be drawn to the mouthpiece portion;

an intermediate inlet fluidly connected to the mouthpiece portion, the intermediate inlet disposed intermediate the distal opening and the mouthpiece portion; and a flow controller moveable at least under the action of gravity to control flow to the mouthpiece portion from the intermediate inlet, according to a selected orientation of the vessel, wherein the flow controller includes a valve member, the position of the valve member being movable between a closed position in which the valve member is seated on a valve seat at which the valve member closes the intermediate inlet and an open position at which the valve member is spaced from the intermediate inlet, the position of the valve member being dependent on the selected orientation of the vessel, wherein the conduit portion includes a main portion and a branch portion and the intermediate inlet is formed at the end of the branch portion and the valve member is in the form of a flap which seats on the valve seat to close the intermediate inlet.

17. The lid portion as claimed in claim 16 wherein the valve member has spring memory characteristics to aid in returning to the closed position.

18. A drinking conduit having two ends including a first end for uptake of fluids and a second end to serve as a mouthpiece, the drinking conduit also provided with an intermediate inlet disposed intermediate the first end and the second end, and a flow controller operable to control flow to the second end from the intermediate inlet, according to a selected orientation of the conduit, wherein the flow controller includes a valve member, the position of the valve member being movable between a closed position in which the valve member is seated on a valve seat at which the valve member closes the intermediate inlet and an open position at which the valve member is spaced from the intermediate inlet, the position of the valve member being dependent on the selected orientation of the conduit, wherein the valve member has a specific gravity greater than 1.

19. The drinking conduit as claimed in claim 18 comprising two or more tubular parts which are separable to facilitate manufacture or cleaning.

20. The drinking conduit as claimed in claim 18 wherein the valve member rests on the valve seat under the action of gravity.

21. The drinking conduit as claimed in claim 18, wherein the intermediate inlet is in the form of one or more curved or annular openings and the valve member is curved or ring-shaped.

22. A drinking conduit having two ends including a first end for uptake of fluids and a second end to serve as a mouthpiece, the drinking conduit also provided with an intermediate inlet disposed intermediate the first end and the second end, and a flow controller operable to control flow to the second end from the intermediate inlet, according to a selected orientation of the conduit, wherein the flow controller includes a valve member, the position of the valve member being movable between a closed position in which the valve member is seated on a valve seat at which the valve member closes the intermediate inlet and an open position at which the valve member is spaced from the intermediate inlet, the position of the valve member being dependent on the selected orientation of the conduit, wherein the valve member is arranged, when seated, to have at least a portion external of the intermediate inlet and extending laterally beyond the intermediate inlet such that the valve member, when seated, is moveable under the action of fluid flow past the valve member.

23. A drinking conduit having two ends including a first end for uptake of fluids and a second end to serve as a mouthpiece, the drinking conduit also provided with an intermediate inlet disposed intermediate the first end and the second end, and a flow controller operable to control flow to the second end from the intermediate inlet, according to a selected orientation of the conduit, wherein the flow controller includes a valve member, the position of the valve member being movable between a closed position in which the valve member is seated on a valve seat at which the valve member closes the intermediate inlet and an open position at which the valve member is spaced from the intermediate inlet, the position of the valve member being dependent on the selected orientation of the conduit, wherein the conduit portion includes a main portion and a branch portion and the intermediate inlet is formed at the end of the branch portion and the valve member is in the form of a flap which seats on the valve seat to close the intermediate inlet.

24. The drinking vessel as claimed in claim 23 wherein the valve member has spring memory characteristics to aid in returning to the closed position.

* * * * *